US012091281B2

(12) United States Patent
Ha et al.

(10) Patent No.: US 12,091,281 B2
(45) Date of Patent: Sep. 17, 2024

(54) WIRE WINDING ADJUSTING DEVICE AND WIRE REEL

(71) Applicant: SHINKYUNG INC, Busan (KR)

(72) Inventors: Min-Woo Ha, Busan (KR); Ki-Ho Ha, Busan (KR)

(73) Assignee: SHINKYUNG INC, Busan (KR)

( * ) Notice: Subject to any disclaimer, the term of this patent is extended or adjusted under 35 U.S.C. 154(b) by 490 days.

(21) Appl. No.: 17/618,149

(22) PCT Filed: Jul. 7, 2020

(86) PCT No.: PCT/KR2020/008858
§ 371 (c)(1),
(2) Date: Dec. 10, 2021

(87) PCT Pub. No.: WO2020/251341
PCT Pub. Date: Dec. 17, 2020

(65) Prior Publication Data

US 2022/0259003 A1 Aug. 18, 2022

(30) Foreign Application Priority Data

Jun. 14, 2019 (KR) ..... 10-2019-0070435
Jul. 3, 2019 (KR) ..... 10-2019-0079746

(51) Int. Cl.
*B65H 75/28* (2006.01)
*A43C 11/16* (2006.01)
*B65H 75/44* (2006.01)

(52) U.S. Cl.
CPC ..... *B65H 75/28* (2013.01); *A43C 11/165* (2013.01); *B65H 75/4421* (2013.01); *B65H 75/4492* (2013.01)

(58) Field of Classification Search
CPC ..... B65H 75/28; B65H 75/4421; B65H 75/4492; B65H 75/4431; B65H 75/4457; B65H 2701/30; A43C 11/165
See application file for complete search history.

(56) References Cited

U.S. PATENT DOCUMENTS

2006/0156517 A1* 7/2006 Hammerslag ..... A43C 11/00 24/68 SK
2010/0299959 A1* 12/2010 Hammerslag ..... A43C 11/16 36/50.5

(Continued)

FOREIGN PATENT DOCUMENTS

KR 10-2015-0032516 A 3/2015
KR 10-1607690 B1 3/2016

(Continued)

*Primary Examiner* — David M Upchurch
(74) *Attorney, Agent, or Firm* — NKL LAW; Jae Youn Kim

(57) ABSTRACT

In order to improve assembling convenience and productivity of products, the present invention provides a wire winding adjusting device comprising a reel portion which is accommodated in a housing unit and is selectively hook-engaged with and rotated interlocking with a rotation manipulation means such that a wire is wound on the outer circumference thereof, wherein the rotation manipulation means is rotated about a driving protrusion at the center thereof during a rotation manipulation. The reel portion comprises: a winding body unit which has a cylindrical shape, has an accommodation groove formed in an upper surface side thereof such that an end portion of the driving protrusion is accommodated in the accommodation groove and a lower surface side which is dented to form a coupling groove portion, and includes a wire tying unit adjacent to the bottom surface of the coupling groove unit and having a first tying hole and a second tying hole through which the wire partially passes and which are formed through the wire tying (Continued)

unit to be apart from each other such that the wire is tied; and a pair of flange portions which expand and protrude outward in the radial direction along upper and lower boundaries of the outer circumferential surface of the winding body unit such that a wire winding groove can be formed between inner surfaces thereof facing each other, and which have a through-slot groove that is open because the first tying hole and the second tying hole are apart from each other along the circumferential direction such that an end portion of the wire pulled into the coupling groove unit can be pressed by a part of the wire.

15 Claims, 25 Drawing Sheets

(56) References Cited

U.S. PATENT DOCUMENTS

| | | | | |
|---|---|---|---|---|
| 2011/0249362 | A1* | 10/2011 | Saichi | G11B 19/2009 310/71 |
| 2016/0213099 | A1* | 7/2016 | Ha | A43C 11/20 |
| 2016/0262497 | A1* | 9/2016 | Midorikawa | A43C 11/165 |
| 2018/0160775 | A1* | 6/2018 | Pollack | B65H 75/4449 |

FOREIGN PATENT DOCUMENTS

| | | | |
|---|---|---|---|
| KR | 10-1723579 | B1 | 4/2017 |
| KR | 10-1810365 | B1 | 12/2017 |
| KR | 10-2018-0078346 | A | 7/2018 |

* cited by examiner

WIRE WINDING ADJUSTING DEVICE AND WIRE REEL

TECHNICAL FIELD

The present disclosure relates to a wire winding adjusting device and a wire reel, and more particularly, to a wire winding adjusting device which can improve assembling convenience and productivity of products, and to a wire reel which is manufactured easily due to a simple wire connection structure.

BACKGROUND ART

In general, shoes such as athletic shoes are provided with shoelaces which can be tightened the shoes to get in close contact with the feet of a wearer. When the wearer pulls the shoelace to tighten, the wearer can walk pleasantly due to improved contactability between the shoes and the feet.

In this case, the conventional shoelace is connected to the upper side of the shoe in a zig-zag form so that the wearer must directly tie or untie the shoelace, but there is a problem in that it is difficult for children or elderly to do such a manipulation. Accordingly, disclosed are devices having a structure in which a shoelace can be quickly and conveniently tightened and loosened by being rotated in a dial form.

FIG. 1 is an exploded perspective view of a conventional device for tightening a shoelace.

As illustrated in FIG. 1, in the case of the conventional device 10 for tightening a shoelace, when a rotation cover 51 is rotated, an intermediate member 53 and a winding member 55 are connected and rotated together. In this instance, a part 242*b* replacing the shoelace can be wound around the winding member 55 to tighten the shoe so that the shoe can fit the feet of the wearer. Here, because an engagement restraining part 53*z* of the intermediate member 53 is engaged with a ratchet gear 57*c* of a housing 57, the winding member 55 is rotated in the reverse direction, thereby preventing the wire (L) from being loosened.

Furthermore, when the wearer pulls the rotation cover 51 upwards, the intermediate member 53 moves upwards together with the rotation cover 51. Therefore, the connected state between the intermediate member 53 and the winding member 55 is released. Then, the winding member 55 rotates freely so that the wire (L) is pulled and released.

Meanwhile, the wire (L) is wound around the outer circumferential surface of the winding member 55 when the rotation cover 51 is rotated in the state in which both end portions of the wire are joined to the winding member 55. In this instance, both end portions of the wire (L) are forcedly fit into a coupling hole formed in the winding member 55, or are fit between divided winding members, or are fastened through a separate fastening part.

Here, when both ends of the wire (L) are doubly folded and forcibly fit through coupling hole formed of the winding member 55, if the size of the coupling hole exceeds twice the cross-sectional area of the part 242*b*, the wire cannot be firmly joined to the winding member. Additionally, since the size of the coupling hole is different according to the diameter of the part 242*b*, productivity is deteriorated.

In addition, when the winding member is divided or is fastened through a separate fastening part, the shape of a mold is complicated, and the number of assembling processes and assembly time are increased, thereby reducing productivity and economic feasibility.

Meanwhile, Korean Patent No. 10-1810365 discloses a fastening structure of wire reel and wire for easy manufacturing, and a wire reel used therein. The conventional wire reel has a disadvantage in that manufacturing is not easy since the fastening structure is too complicated as disclosed in Korean Patent No. 10-1810365.

DISCLOSURE

Technical Problem

The present disclosure has been made to solve the above-mentioned problems occurring in the prior art, and it is an object to provide a wire winding adjusting device which can improve assembling convenience and productivity of products.

It is another object to provide a wire winding adjusting device and a wire reel to prevent interference between wires when a wire is fastened while supporting another wire entering in a second direction by forming a gradient along a central partition wall.

Technical Solution

To accomplish the above objects, there is provided a wire winding adjusting device, which includes a reel part accommodated in a housing part and selectively engaging with a rotating means rotating around a driving protrusion disposed at the central portion so as to be rotated interlocking with the rotating means such that a wire is wound on the outer circumference thereof, wherein the reel part includes: a winding body part of a cylindrical shape, which has a receiving groove formed in the upper surface thereof such that an end portion of the driving protrusion is accommodated, a fastening groove part formed such that a lower surface is recessed, and a wire fastening part getting in contact with the bottom surface of the fastening groove part so that the wire is fastened and having a first coupling hole and a second coupling hole which are spaced apart from each other and through which a portion of the wire passes; and a pair of flange parts which expand and protrude outwards in the radial direction along upper and lower rims of the outer circumferential surface of the winding body part such that a wire winding groove can be formed between inner surfaces thereof facing each other, and which have via slots formed since the first coupling hole and the second coupling hole are spaced apart from each other in the circumferential direction such that an end portion of the wire inserted into the fastening groove part is pressed by a portion of the wire.

Moreover, a support stepped part of which one surface is continuously extended to an inner circumferential surface of the second coupling hole protrudes on the fastening groove part so that the portion of the wire drawn out through the second coupling hole and reinserted through the via slot is bent and is supported to keep the bent state.

Furthermore, the via slot is formed in the lower flange part extending outwards in the radial direction from the edge of the opening of the fastening groove part, and the inner end portion of the via slot and the first coupling hole or the second coupling hole are spaced apart from each other in the vertical direction corresponding to the recessed depth of the fastening groove part.

Additionally, the first coupling hole and the second coupling hole respectively have penetration paths intersecting each other at a predetermined angle, and the via slot and the second coupling hole are divided by a partition wall having at least one edge portion at the outer end portion thereof.

In addition, a protrusion part having a seating groove on which the end portion of the wire is seated is formed to protrude on the bottom surface of the fastening groove part corresponding in the vertical direction of the via slot.

In another aspect of the present invention, there is provided a wire reel including: a wire winding part having first, second and third wire through-holes formed in a wire winding surface on which the wire is wound by rotation, so that the wire is inserted from the outside to the inside of a body; a wire fastening part having a wire fastening groove recessed from the body so as to have a first direction fastening area where the wire is inserted through a first wire through-hole from the outside of the body to the inside, a second direction fastening area where the wire is inserted through a second wire through-hole from the inside of the body to the outside in the opposite direction to a first direction, and a third direction fastening area where the wire is inserted through a third wire through-hole from the outside of the body to the inside in the same direction as the first direction, so that the wire is fixed and fastened at the wire fastening groove; and a gear part having a gear which protrudes outwards from the body so that the body is rotated by engagement of the gear.

Moreover, the wire fastening groove is formed to be a horizontal groove to prevent interference caused by movement of the wire passing the first to third direction fastening areas.

Furthermore, the wire fastening part includes: a first wire fastening part for fixing and fastening one side of the wire; a second wire fastening part for fixing and fastening the other side of the wire; and a central partition wall formed from one side to the other side of the wire fastening groove to partition the first and second wire fastening parts.

Additionally, the first wire fastening part includes a first wire fastening groove which is formed at one side area from the central partition wall by being cut from the body and has the first to third direction fastening areas, and a first inclined wall which gets in close contact with the central partition wall and allow the wire to enter at a predetermined angle when the wire is inserted in the second direction fastening area. The second wire fastening part includes a second wire fastening groove which is formed at the other side area from the central partition wall by being cut from the body and has the first to third direction fastening areas, and a second inclined wall which gets in close contact with the central partition wall and allow the wire to enter at a predetermined angle when the wire is inserted in the second direction fastening area.

In addition, the first and second inclined walls are in close contact with the central partition wall, and are shorter than the central partition wall to have a predetermined length so that the wire can be inserted through the second wire through-hole when entering the second direction fastening area.

Moreover, the first and second inclined walls are inclined in such a way that the height is reduced gradually in the inserted direction when the wire is inserted in the second direction.

Furthermore, the first and second inclined walls are relatively lower than the central partition wall and are inclined in such a way that the height is reduced gradually in the inserted direction so that the wire is guided to be inserted in the direction of the second wire through-hole.

Additionally, each of the first and second inclined walls includes: a horizontal part which gets in close contact with the central partition wall and horizontally extends to be relatively low; and an inclined part which gets in close contact with the central partition wall, extends from the horizontal part, and is inclined in such a way that the entire length is shorter than the central partition wall so as to have a predetermined length.

In addition, the inclined part is shorter than the horizontal part so that the wire seated in the third direction fastening area is fixed and fastened without any interference since the wire inserted in the first direction is pulled in the opposite direction to the insertion direction.

In another aspect of the present invention, there is provided a wire reel including: a first direction fastening area through which a wire inserted through a first wire through-hole passes from the outside of the body to the inside in a first direction; a second direction fastening area through which the wire is discharged out through a second wire through-hole from the inside of the body to the outside in a second direction that is the opposite direction to the first direction, the second direction fastening area allowing the wire to be inclinedly inserted before entering a second wire through-hole while maintaining a predetermined height from a wire fastening groove of a body when the wire enters the second direction; and a third direction fastening area on which the wire inserted through a third wire through-hole from the outside of the body to the inside in the same direction as the first direction is seated, wherein since the wire is inclinedly inserted before entering the second wire through-hole while maintaining a predetermined height from the wire fastening groove, the wire seated on the third direction fastening area is fixed and fastened without any interference when the wire inserted in the first direction is pulled in the opposite direction to the insertion direction.

Advantageous Effects

The wire winding adjusting device according to the present invention provides the following effects.

First, the wire winding adjusting device according to the present invention can entirely utilize also the central portion of the reel part as a fastening space for fastening the wire, differently from the conventional arts in which both ends of the wire are fastened in a rotationally symmetrical form in the narrow space of the outer circumference since the central portion is penetrated.

Second, since a pressing step capable of firmly pressing an end portion of the wire is formed to the maximum at the portion of the wire even though the thickness of the winding body part is not increased, the reel part can be manufactured to have the minimum thickness, and a product to which the reel part is applied can be made compact.

Third, because a portion of the wire passing through the first coupling hole and the second coupling hole is supported and bent on one side of the support stepped part continuously extending and protruding to the inner circumferential surface of the second coupling hole so as to fix the bent state, the fastened state of the wire can be firmly maintained even during repetitive manipulation of the product.

The present invention can prevent interference between wires when a wire is fastened while supporting another wire entering in a second direction by forming a gradient along the central partition wall.

MODE FOR INVENTION

Hereinafter, a wire winding adjusting device according to a preferred embodiment of the present invention will be described in detail with reference to the accompanying drawings.

Figure 1:
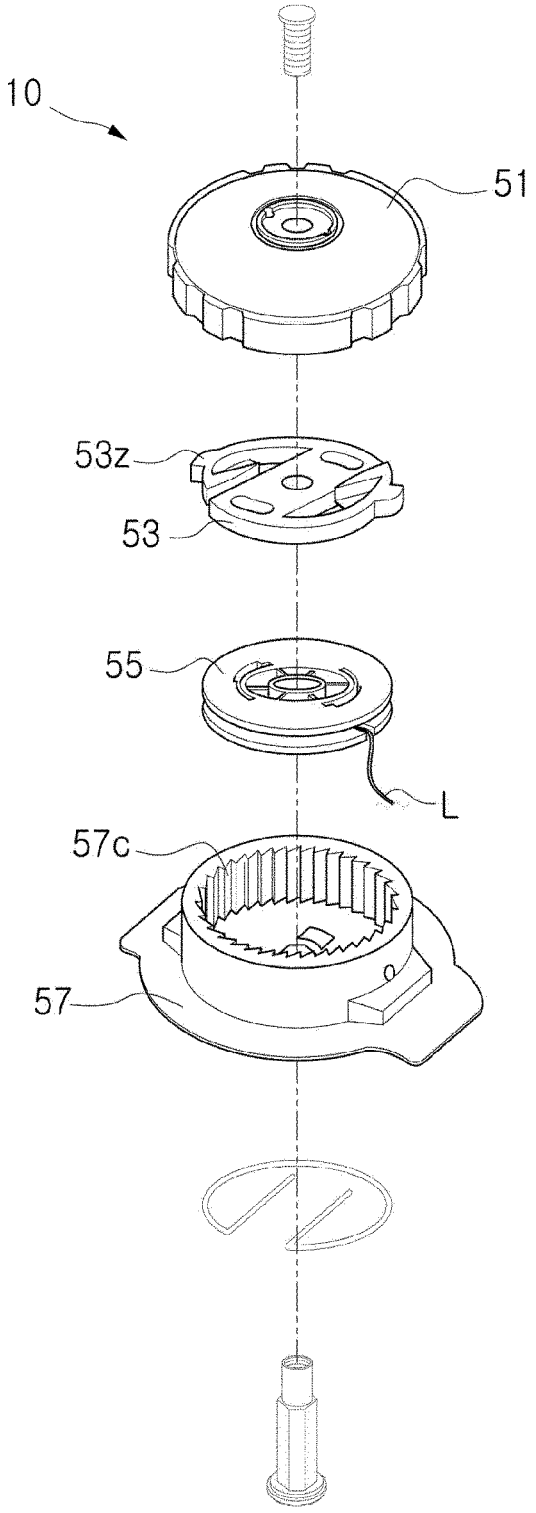
FIG. 1 is an exploded perspective view of a conventional device for tightening a shoelace.
Figure 2:
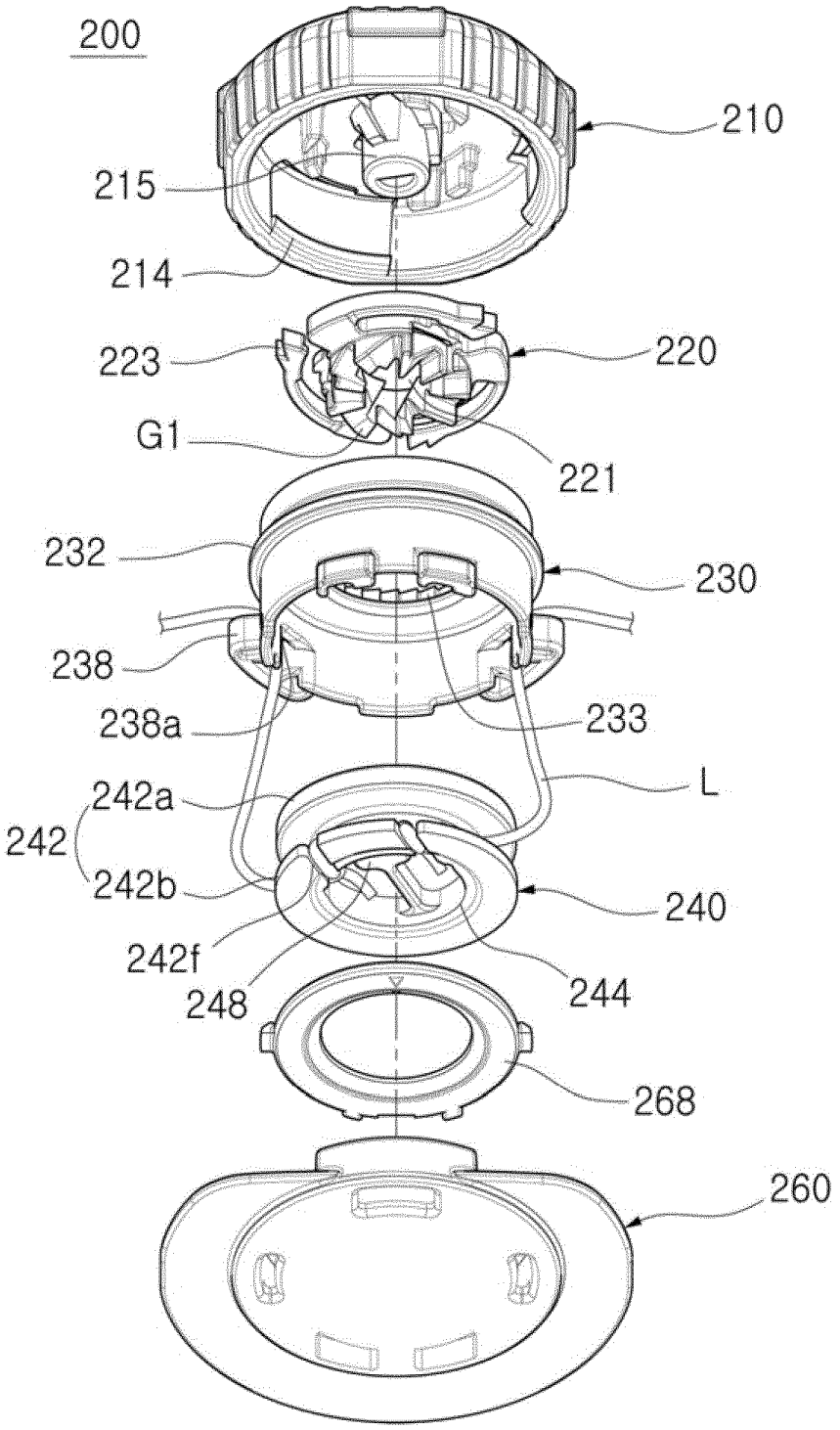
FIG. 2 is an exploded perspective view of a wire winding adjusting device according to an embodiment of the present invention.
Figure 3:
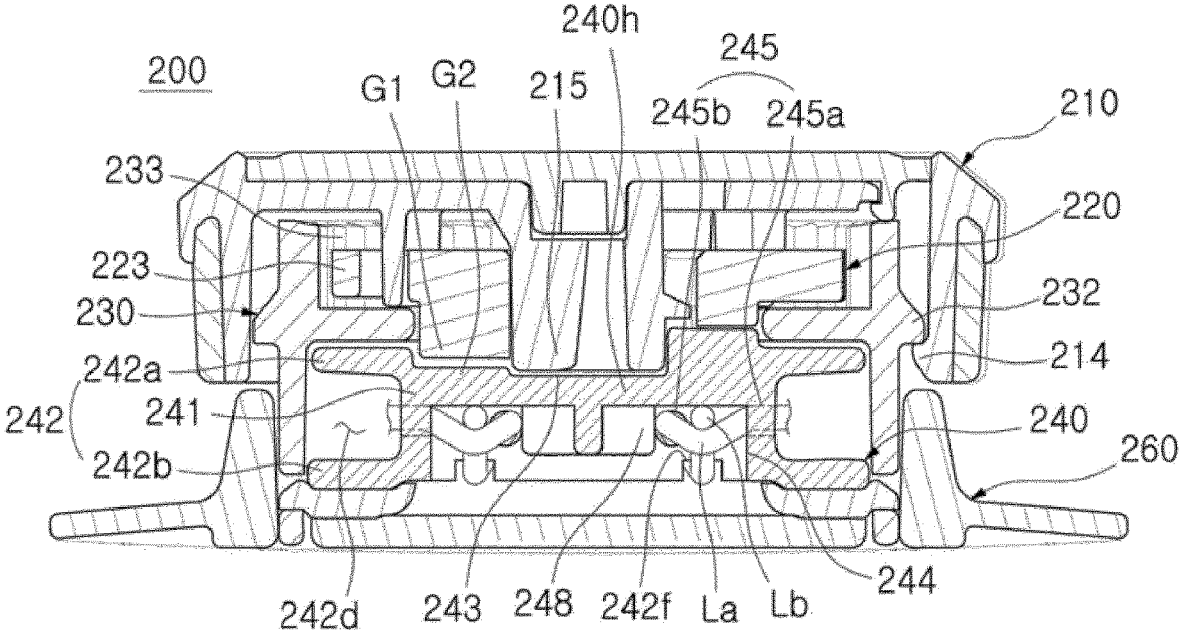
FIG. 3 is a vertically sectional view of the wire winding adjusting device according to an embodiment of the present invention.

FIG. 2 is an exploded perspective view of a wire winding adjusting device according to an embodiment of the present invention, and FIG. 3 is a vertically sectional view of the wire winding adjusting device according to an embodiment of the present invention. Moreover, FIG. 4 is a perspective view of the bottom surface of a reel part applied to the wire winding adjusting device according to an embodiment of the present invention, viewed from the top.

Figure 4:
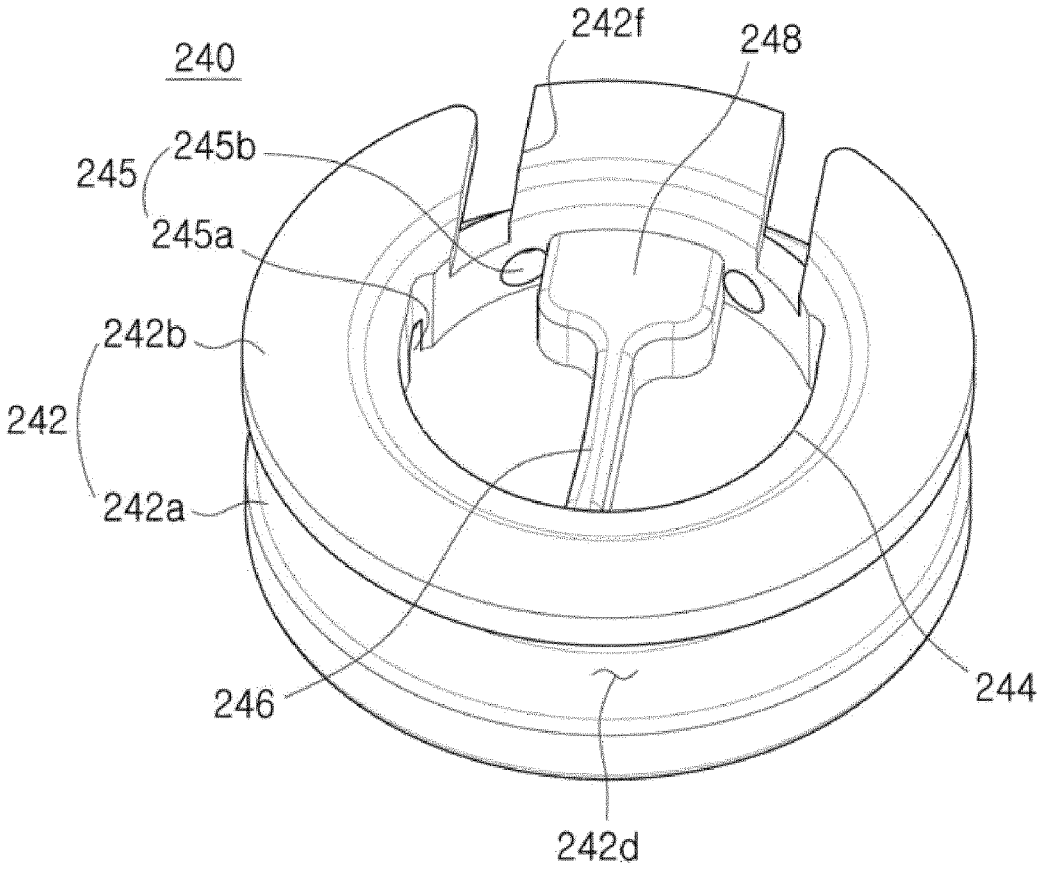
FIG. 4 is a perspective view of the bottom surface of a reel part applied to the wire winding adjusting device according to an embodiment of the present invention, viewed from the top.

In this instance, FIG. 4 is a sectional view illustrating a state in which a lower surface of a reel part 240 is arranged upwards. In the following embodiments, it would be understood that portions which are expressed as "downwards" or "lower side" are illustrated "upwards" or "upper side" in the drawings. Additionally, in the present invention, the expression of "front" or "the other side" corresponds to the direction that a part 242*b* is inserted into a fastening groove part 244 formed in the reel part 240, and the expression of "rear" or "one side" corresponds to the direction that the wire (L) is drawn out from the fastening groove part 244.

More specifically, as illustrated in FIGS. 2 and 3, the wire winding adjusting device 200 according to an embodiment of the present invention includes a housing part 230, a rotation operating unit, and the reel part 240.

The wire winding adjusting device 200 is fixed to an object to be fastened, and is provided to adjust the size of the object while the wire (L) arranged to pass via the circumference or one side of the object is wound into the wire winding adjusting device during rotation operation.

Here, it would be understood that the object to be tightened means all kinds of article which is adjusted in size to get in close contact with a wearer's body through a part 242*b* so as to be worn on the wearer's body. For example, the objects to be tightened may be shoes such as sneakers, head wearable articles such as hats, articles such as belts, gloves, bags, etc., athletic goods such as snow boards, water skis, and clothes. Moreover, the present invention is applicable to other devices to which the technical idea of the present invention is applied.

More specifically, the housing part 230 is coupled to an upper side of a coupling base part 260 fixed to the object, and has a ratchet gear 233 formed along the inner circumferential surface. In addition, the reel part 240 is accommodated in the housing part 230, and the rotating means and the reel part 240 are selectively rotated interlocking with each other so that the wire (L) is wound on the outer circumferential surface of the reel part 240 according to rotation. Moreover, the housing part 230 has a guide protrusion 238 having an inlet hole 238*a* so that an end portion (Lb) of the wire is inserted into the reel part 240 from the outside.

In this instance, the rotating means is rotated around a driving protrusion 215 disposed in the central portion, and includes a rotation cover 210 and a gear part 220. In detail, the rotation cover 210 is rotatably coupled to the upper end of the housing part 230 by an external force, and a first hook protrusion 214 and a second hook protrusion 232 coupled with each other respectively protrude from the facing surfaces of the sides of the rotation cover 210 and the housing part 230.

Furthermore, a gear part 220 is disposed on the inner upper portion of the housing part 230 to which the rotation cover 210 is coupled, and the reel part 240 is disposed at the lower part of the inside of the housing part 230. Here, the gear part 220 is lifted up and down in the inner part of the housing part 230 when the rotation cover 210 is operated, and a gear engagement part (G1), which is selectively engaged with a gear coupling part (G2) upwardly protruding from the upper surface of the reel part 240, protrudes downwards. Furthermore, the gear part 220 has a ratchet coupling part 223 selectively engaged with the ratchet gear 233 to restrict rotation in the other direction, and a lifting hole 221 penetrated by the driving protrusion 215 is formed in the central portion.

In this instance, when the wearer operates the rotation cover 210 so that the gear part 220 descends, the gear engagement part (G1) and the gear coupling part (G2) are engaged. In addition, when the rotation cover 210 is rotated while the gear engagement part (G1) and the gear coupling part (G2) are engaged, the reel part 240 is rotated. So, a tensile force is applied so that the object can be tightened while the wire (L) is wound on the outer circumferential surface of the reel part 240. At this time, an auxiliary cap part 268 is disposed on the lower surface of the reel part 240 to prevent abrasion due to friction with a bottom surface 244*d* of the coupling base part 260 when the reel part 240 rotates.

Moreover, when the gear part 220 is lifted by operation of the rotation cover 210, the gear engagement part (G1) and the gear coupling part (G2) are separated. Accordingly, the reel part 240 is freely rotated without being interlocked with the rotating means, so that the tensile force applied to the object is lost when the wire (L) is released.

The conventional configuration and operation method of the wire winding adjusting device 200 have been disclosed in Korean Patent Nos. 10-1723579, 10-1249420 and 10-1438572, and the detailed descriptions thereof will be omitted.

Referring to FIGS. 3 to 4, the reel part 240 includes a winding body part 241 and a flange part 242. Here, the winding body part 241 is provided in a cylindrical shape, and the flange part 242 is extended radially outwards along the upper and lower rims of the outer circumferential surface of the winding body part 241. Furthermore, when the wire winding adjusting device 200 is rotated, the wire (L) is wound on a wire winding groove 242*d* formed between the inner surfaces facing the flange part 242.

The winding body part 241 preferably includes a fastening groove part 244 and a wire fastening part 245.

In detail, the gear coupling part (G2) protrudes from the upper surface of the winding body part 241, and a receiving groove 243 in which the end portion of the driving protrusion 215 is received is formed at the central portion of the gear coupling part (G2). In addition, the fastening groove part 244 is recessed on the lower surface of the winding body part 241, and the end portion (Lb) of the wire is inserted/withdrawn or is pressed and fastened to a portion (La) of the wire.

As described above, the portion to which the wire (L) is fastened is accommodated in the fastening groove part 244 which is recessed on one side of the reel part 240. Accordingly, the end portion of the wire fastened to the reel part 240 protrudes outside the reel part 240 or an exposed portion is minimized. Therefore, malfunction caused by interference during rotation of the wire winding adjusting device 200 and damages of products caused by the malfunction can be prevented in advance.

Additionally, the driving protrusion 215 protrudes downwards from the rotation cover 210, and extends to the minimum length capable of lifting and rotating the gear part 220. Therefore, the driving protrusion 215 can be directly coupled only to the lifting hole 221 of the gear part 220. Moreover, the winding body part 241 is formed in a structure in which the receiving groove 243 and the fastening groove part 244 are not vertically communicated and are divided vertically by a transverse partition wall 240*h*.

That is, the reel part 240 according to the present invention has a structure in which a penetration part is not formed in the central portion. Therefore, the fastening groove part 244 can be formed entirely on the lower surface side of the winding body part 241, and a space in which the wire (L) is inserted or withdrawn is sufficiently secured.

On the other hand, the wire fastening part 245 preferably includes a first coupling hole 245*a* and a second coupling hole 245*b* formed through the inner side of the fastening groove part 244 from the rear side of the winding body part 241.

In detail, the first coupling hole 245*a* and the second coupling hole 245*b* are adjacent to a bottom surface 244*d* of the fastening groove part 244 and are spaced apart from each other at both sides. Accordingly, the wire (L) is inserted into the fastening groove part 244 through the first coupling hole 245*a* and is withdrawn to the outside through the second coupling hole 245*b*, and a part (La) of the wire is arranged to pass between the first coupling hole 245*a* and the second coupling hole 245*b*.

In this instance, it is preferable that each bottom end of the first coupling hole 245*a* and the second coupling hole 245*b* be continuously formed with the bottom surface 244*d* of the fastening groove part 244. Of course, the bottom end portion of the second coupling hole 245*b* is formed to be stepped at a predetermined interval within a vertical gap between the bottom surface 244*d* of the fastening groove part 244 and the edge of an opening. Accordingly, the vertical gap between the second coupling hole 245*b* and a via slot 242*f* gets narrower. Therefore, a bending angle of a bent portion (Lc) of the wire (L) passing through the second coupling hole 245*b* and the via slot 242*f* is formed to be small. Accordingly, the present invention can further improve fastening stability since the wire (L) fastened to the reel part is prevented from being loosened.

Meanwhile, the flange part 242 includes a pair of an upper flange part 242*a* and a lower flange part 242*b* protruding along upper and lower edges of the winding body part 241. In this instance, it is preferable that the flange part 242 have the via slot 242*f* formed in such a way that the first coupling hole 245*a* and the second coupling hole 245*b* are spaced apart from each other at a predetermined interval in the circumferential direction so that the end portion (Lb) of the wire is reinserted into the fastening groove part 244 to be pressed to a portion (La) of the wire.

In detail, the via slot 242*f* is formed in the lower flange part 242*b* extending radially outwards from the edge of the opening of the fastening groove part 244, among a pair of the flange parts 242. It is preferable that a pair of the via slots 242*f* be spaced apart from each other to have a width exceeding the diameter of the wire (L) and to have a depth corresponding to the thickness of the flange part 242. That is, the flange part 242 is formed in a ring shape divided in the circumferential direction by the via slots 242*f*, and the inner end portion of the via slot 242*f* substantially corresponds to the edge end portion of the opening of the fastening groove part 244.

Accordingly, the wire (L2) drawn out through the second coupling hole 245*b* is reinserted through the via slot 242*f* while being in contact with the outer surface of the winding body part 241. In this instance, since the via slot 242*f* is formed to be spaced apart from the edge of the opening of the fastening groove part 244, a gap between the bent parts, which are supported and bent at stepped points of the reel part 240 while the wire (L) passes through, is densely formed.

Here, it is preferable that the stepped points of the reel part 240 mean connection parts of the inner end portions of the coupling holes 245*a* and 245*b*, one side and an edge portion 245*e* of a support stepped part 248, the inner end portion of the via slot 242*f*, and connected portions between the bottom surface 244*d* and the inner surface of the fastening groove part 244. Accordingly, the wire (L) is firmly fixed and fastened by being bent in multiple stages at each stepped point.

In this instance, the inner end portion of the via slot 242*f* and the first coupling hole 245*a* or the second coupling hole 245*b* are preferably spaced apart from each other in a vertical direction corresponding to the recessed depth (d1) of the fastening groove part 244. That is, a pressurized step formed to receive a fastening force when the end portion (Lb) of the wire reinserted through the via slot 242*f* is pressed to the portion (La) of the wire may be formed corresponding to a recessed depth (d1) of the fastening groove part 244.

Therefore, the end portion (Lb) of the wire is primarily bent with respect to the inner end portion of the via slot 242*f*, and is secondarily bent by being pressurized to get in contact with the bottom surface 244*d* of the fastening groove part 244, and each bent point is formed to be clear. Therefore, even without a separate fixing member or a pressing member, the wire (L) is fixed by a mutual pressing force in a state in which the wire (L) is bent in multiple stages, thereby firmly maintaining a fastened state.

Moreover, since the via slot 242*f* is formed on the lower flange part 242*b* rather than the winding body part 241, the pressurized step can be maximally formed even if a longitudinal thickness of the winding body part 241 is increased. Accordingly, the reel part 240 can be manufactured to the minimum thickness, and the wire winding adjusting device 200 to which the reel part 240 is applied can be made compact.

In addition, although not shown in the drawings, a fastening guide mark part for guiding the fastening step of the wire (L) is formed on the outer surface of the reel part 240 corresponding to the first coupling hole 245*a* and the second coupling hole 245*b*.

In detail, the fastening guide mark part may include marks, such as numbers corresponding to the coupling holes 245*a* and 245*b* or arrows which guide a direction that the wire (L) passes through the coupling holes 245*a* and 245*b*. Moreover, each mark of the fastening guide mark part may be indicated on the outer surface of the lower flange part 242*b* vertically corresponding to the position where each of the coupling holes 245*a* and 245*b* penetrates.

Accordingly, the penetration position can be intuitively and accurately recognized even if the outer end portions of the coupling holes 245*a* and 245*b* are hidden by the flange part 242. In addition, once the wire (L) passes in accordance with the numbers or the arrow directions indicated on the fastening guide mark unit, the wire can pass through the fastening position accurately. Therefore, even in the case of an unskilled person, the person can easily fasten the wire (L) along the fastening guide mark part, thereby significantly improving productivity. The fastening guide mark part is integrally marked on the reel part 240 to be engraved or embossed, or it is also possible to be printed or manufactured in the form of a sticker to be adhered.

On the other hand, the fastening groove part 244 is preferably provided with a support stepped part 248 of which one surface is continuously extended to an inner circumferential surface 245*c* of the second coupling hole 245*b* so that the portion (La) of the wire drawn out through the second coupling hole 245*b* is supported to keep the bent state.

In detail, the end portion (Lb) of the wire inserted into the fastening groove part 244 through the first coupling hole 245*a* is withdrawn out to the outer circumference of the winding body part 241 through the second coupling hole 245*b*. Moreover, the wire is withdrawn out in the state in which the portion (La) of the wire is supported on one surface of the support stepped part 248, and the end portion (Lb) of the wire is reinserted into the fastening groove part 244 through the via slot 242*f*. In this instance, the wire (L) has the bent portion (Lc) formed on the outer circumferential surface of the winding body part 241 while passing through the second coupling hole 245*b* and the via slot 242*f*. Furthermore, as the portion (La) of the wire is supported on the support stepped part 248, the bent portion (Lc) of the wire can maintain the state in which the bent portion is rapidly bent at a small bending angle. Accordingly, even if the wire winding adjusting device 200 is used for a long time, the wire (L) can be stably fixed to the reel part 240.

Here, the supporting stepped part 248 may have a protrusion structure to have a predetermined area from the inner surface of the rear side of the fastening groove part 244 toward the front side. Additionally, the first coupling hole 245*a*, the second coupling hole 245*b*, and the via slot 242*f* are preferably provided in a pair which are symmetrical with respect to the support stepped part 248. That is, a horizontal width of the support stepped part 248 and an interval between the inner circumferential surfaces 245*c* of the second coupling holes 245*b* correspond to each other. In addition, the pair of first coupling holes 245*a* are formed to be spaced apart from outer end portions of the second coupling holes 245*b* in the outward direction, and the pair of via slots 242*f* are formed between the first coupling holes 245*a* and the second coupling holes 245*b* which are symmetrical to each other on the basis of the support stepped part 248.

In this instance, the support stepped part 248 is continuously extended from the rear side of the fastening groove part 244 to the front side so as to divide the fastening groove part 244 into both sides. Alternatively, a central partition wall 246 is formed by the support stepped part 248 which extends to the front of the fastening groove part 244 from the front end portion of the support stepped part 248 to have a predetermined length. In this instance, the central partition wall 246 is formed to have a width narrower than the width of both sides of the support stepped part 248.

Both ends of the wire (L) are respectively coupled to the first coupling holes 245*a*, the second coupling holes 245*b*, and the via slots 242*f* which are symmetrically formed with respect to the support stepped part 248, and the central portion of the wire is preferably arranged to pass via the circumference or one surface of the object to be fastened. Of course, the wire (L) may be arranged such that one end of the wire is coupled to each of the first coupling hole 245*a*, the second coupling hole 245*b*, and the via slot 242*f*, which are symmetrically formed on the basis of the support stepped part 248, and the other end is arranged to individually or symmetrically pass the circumference or one surface of the object.

As described above, as the fastening groove part 244 is divided into both sides, the coupling holes 245*a* and 245*b* and the via slot 242*f* for fixing one end or both ends of the wire (L2) are symmetrically arranged. Accordingly, inconvenience of rotating the reel part 240 to fasten the wire (L2) can be minimized.

Moreover, the directions to pull the wire (L) is substantially the same in order to fasten both ends or one end of the wire (L). Therefore, a user can hold and pull both ends or one end of the wire (L) in the state in which the both ends or one end of the wire (L) have passed through the coupling holes 245*a* and 245*b* and the via slots 242*f* Accordingly, since both ends or one end of the wire (L) can be coupled and fixed at the same time just by one pulling action, the present invention can remarkably improve productivity since assembly convenience is remarkably improved and assembly time is shortened.

Furthermore, as the central partition wall 246 is narrower than the support stepped part 248, the quantity of materials required to manufacture the reel part 240 can be reduced. At the same time, the coupling area of both ends or one end of the wire (L) is clearly distinguished, and a clearance space capable of being easily taken by a worker is secured, thereby significantly improving work convenience.

Additionally, since the fastening groove part 244 is formed to correspond to the cross-sectional area of the winding body part 241, the first coupling hole 245*a*, the second coupling hole 245*b*, and the via slot 242*f* are symmetrically provided on the reel part 240 as described above. Accordingly, the inconvenience of the conventional arts that the reel part 240 is rotated to assemble both ends or one end of the wire (L) can be fundamentally removed.

That is, the present invention has a pair of the first coupling holes (245*a*), a pair of the second coupling holes 245*b*, and a pair of the via slots 242*f*, which are arranged to be bilaterally symmetrical, and, of which the opening directions correspond to each other on the rear side of the reel part 240. Therefore, unlike the conventional arts in which the first coupling holes 245*a*, the second coupling holes 245*b*, and the via slots 242*f* are rotationally symmetrical by the penetration part formed in the central part, the present invention has the first coupling holes 245*a*, the second coupling holes 245*b*, and the via slots 242*f* which are arranged bilaterally symmetrical. So, the present invention can easily fasten both ends or one end of the wire (L) in a state in which the reel part 240 is fixedly arranged.

Figure 5A:
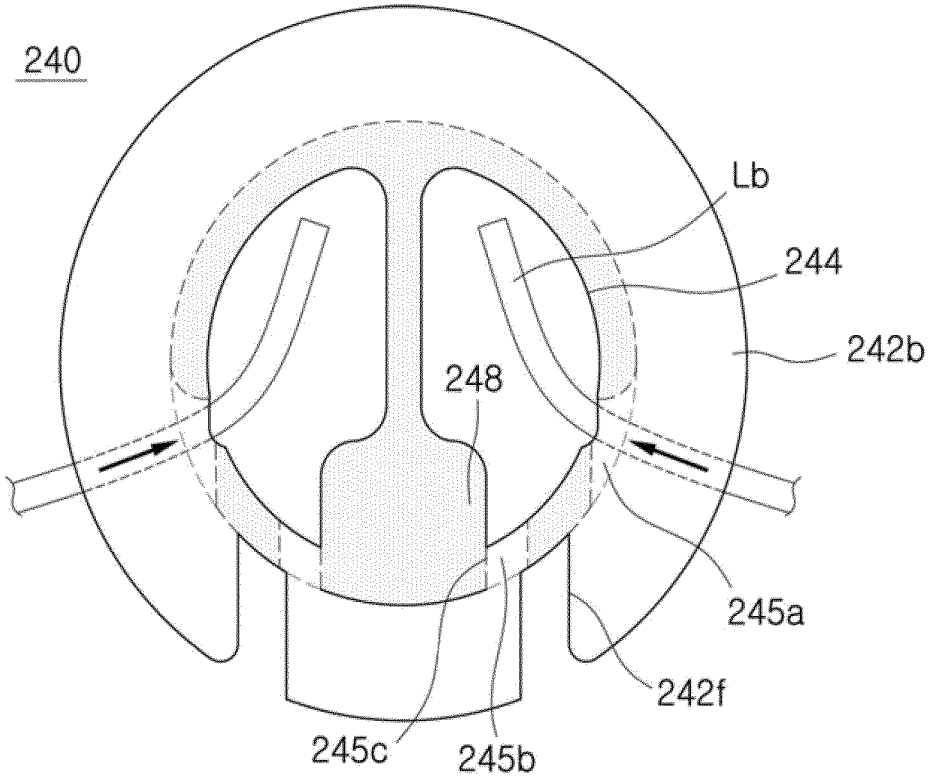
FIGS. 5*a* to 5*d* is a partially projective view illustrating a process of fastening a wire to the reel part applied to the wire winding adjusting device according to an embodiment of the present invention, viewed from the top.
Figure 5B:
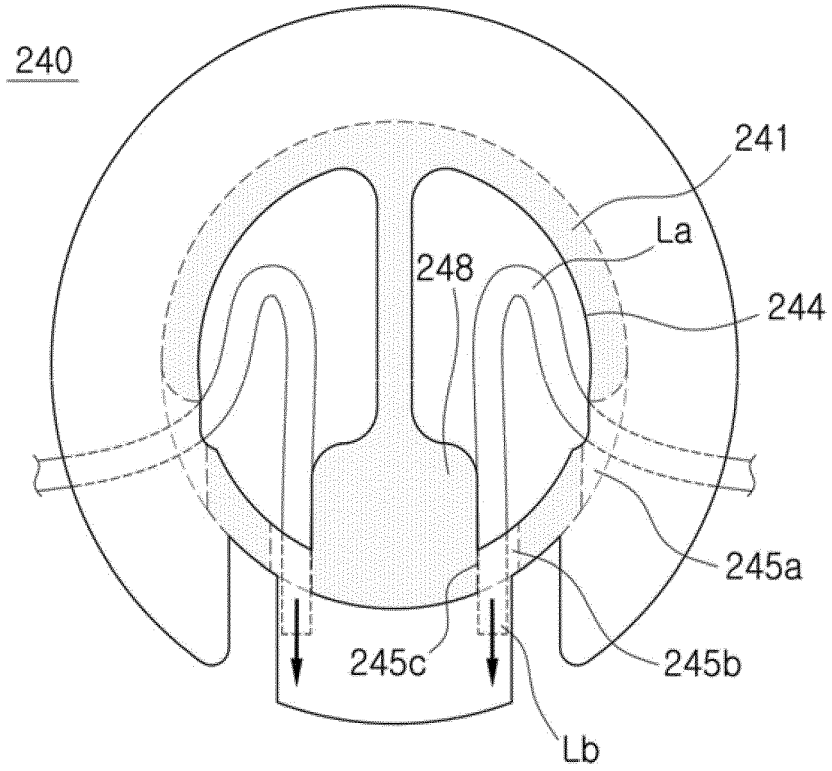
Figure 5C:
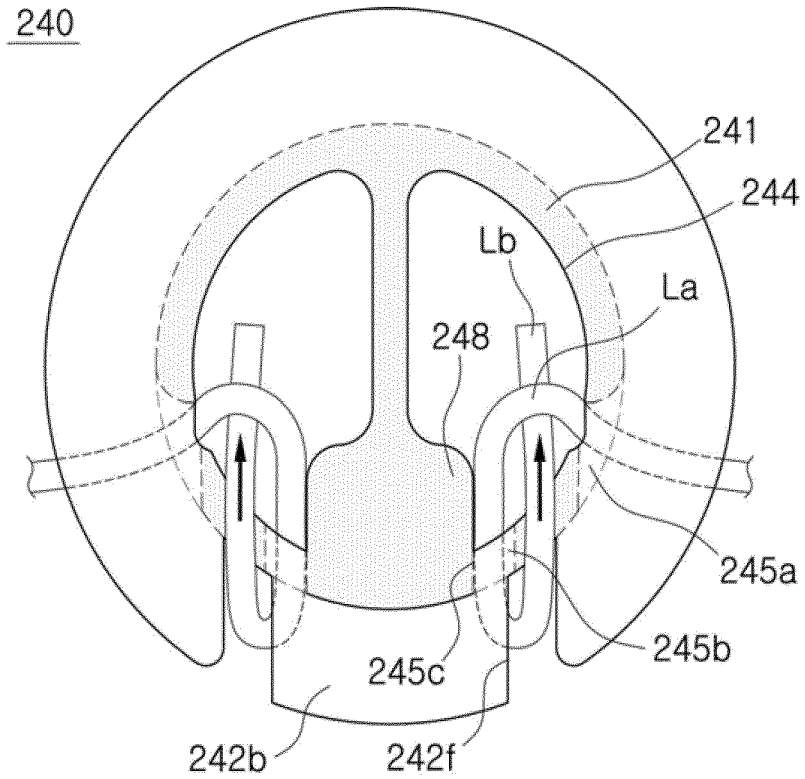
Figure 5D:
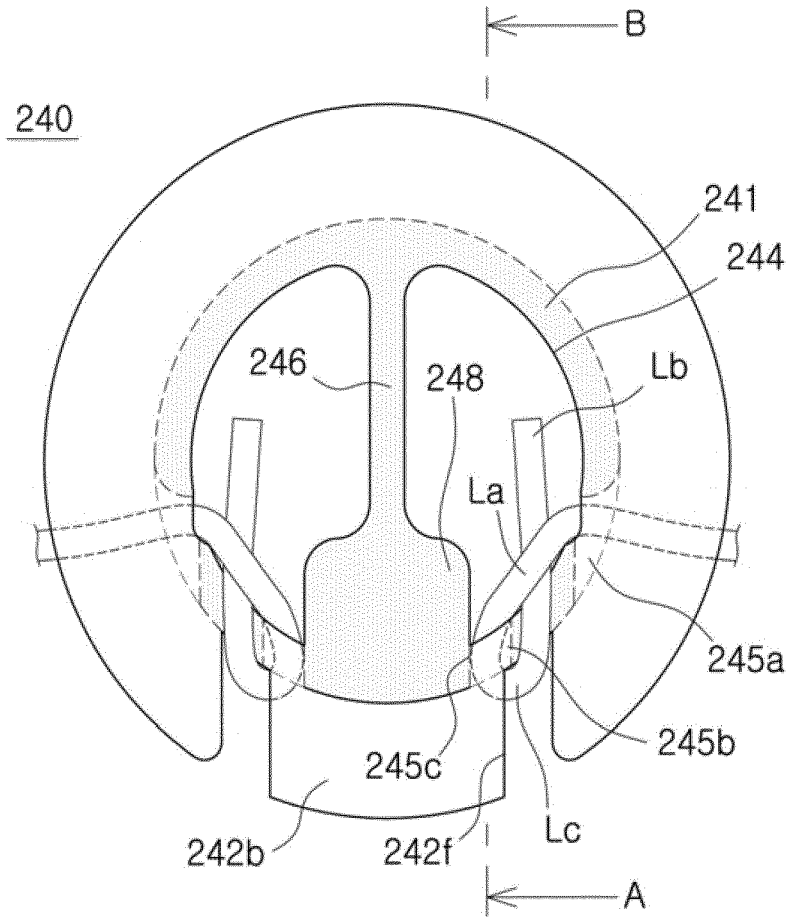
Figure 6:
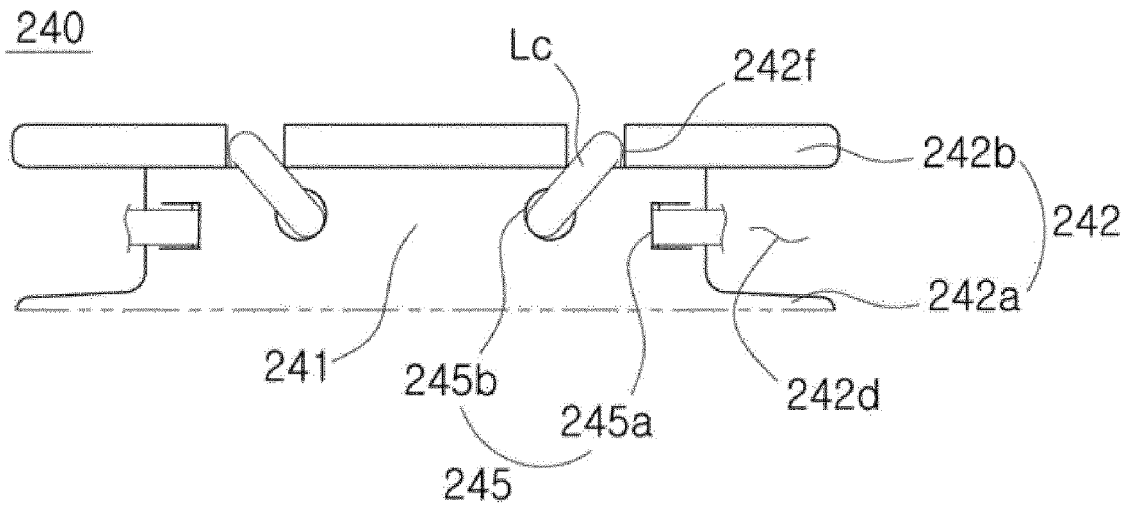
FIG. 6 is a side view illustrating the reel part applied to the wire winding adjusting device according to an embodiment of the present invention.
Figure 7:
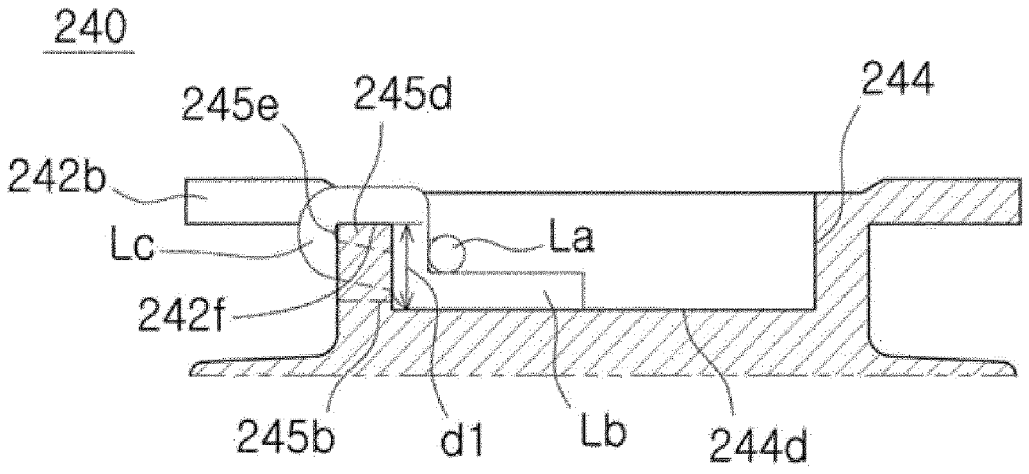
FIG. 7 is a sectional view taken in the direction of A-B of FIG. 5*d*.

FIGS. 5*a* to 5*d* is a partially projective view illustrating a process of fastening a wire to the reel part applied to the wire winding adjusting device according to an embodiment of the present invention, viewed from the top, FIG. 6 is a side view illustrating the reel part applied to the wire winding adjusting device according to an embodiment of the present invention, and FIG. 7 is a sectional view taken in the direction of A-B of FIG. 5*d*.

In this instance, preferably, the parts indicated boldly in FIGS. 5*a* to 5*d* are to distinguish between the coupling holes/groove part and a solid body. In addition, FIG. 6 to FIG. 7 are a side view and a sectional view illustrating a state in which the lower surface of the reel part 240 is disposed upwards, it would be understood that portions which are expressed as "downwards" or "lower side" are illustrated "upwards" or "upper side" in the drawings.

As illustrated in FIGS. 5*a* through 7, the process of fastening the wire (L) to the reel part 240 will be described as follows. Preferably, both ends of the wire (L) are coupled to the first coupling holes 245*a*, the second coupling holes 245*b*, and the via slots 242*f*, which are symmetrically formed by the support stepped part 248 and the central partition wall (246).

Referring to FIGS. 5*a* and 5*b*, the end portion (Lb) of the wire is inserted into the fastening groove part 244 through the first coupling hole 245*a*. Then, when the end portion (Lb) of the wire inserted into the fastening groove part 244 is drawn out to the outside of the winding body part 241 through the second coupling hole 245*b*, the portion (La) of the wire is arranged in a ring shape which is convex toward the front side of the fastening groove part 244. In this instance, the end portion (Lb) of the wire can be easily guided to the second coupling hole 245*b* while being slid along the support stepped part 248.

Here, the first coupling holes 245*a* and the second coupling holes 245*b* are preferably formed such that a penetration path of each first coupling hole 245*a* and a penetration path of each second coupling hole 245*b* intersect each other at a predetermined angle.

In detail, the second coupling hole 245*b* is formed such that the inner circumferential surface (245*c*) is extended to one surface of the support stepped part 248 to have a continuous profile. Moreover, the second coupling hole 245*b* is spaced apart from the first coupling hole 245*a* at a predetermined interval, and preferably, is spaced to exceed the diameter of the wire (L). Accordingly, the portion (La) of the wire passing through the first coupling hole 245*a* and the second coupling hole 245*b* can press the bottom side of the fastening groove part 244 while generally surrounding the end portion (Lb) of the wire reinserted through the via slot 242*f*.

In this instance, as the first coupling hole 245*a* is formed to have the penetration path crossing the second coupling hole 245*b* at the predetermined angle, the end portion (Lb) of the wire can be guided to the inside of the fastening groove part 244 in which a sufficient clearance space is secured when the end portion (Lb) of the wire is inserted through the first coupling hole 245*a*.

Referring to FIGS. 5*c* to 5*d*, the end portion (Lb) of the wire drawn through the second coupling hole 245*b* is reinserted into the fastening groove part 244 through the via slot 242*f*. At this time, the end portion (Lb) of the wire is arranged between the portion (La) of the wire arranged in a ring shape and the bottom surface 244*d* of the fastening groove part 244.

Then, when the wire (L) exposed to the first coupling hole 245*a* is pulled, the portion (La) of the wire is pulled to get in close contact with the bottom surface 244*d* of the fastening groove part 244 and the end portion (Lb) of the wire is pressurized. Accordingly, both ends or one end of the wire (L) can be firmly fastened to the reel part 240.

In this instance, the via slot 242*f* is formed in the lower flange part 242*b* corresponding between the first coupling hole 245*a* and the second coupling hole 245*b*, and is preferably eccentric to be adjacent to the second coupling hole 245*b*. Accordingly, a linear gap between the outer end of the second coupling hole 245*b* and the inner end of the via slot 242*f* is minimized.

Furthermore, the via slot 242*f* is opened corresponding to the thickness of the lower flange part 242*b*, and the thickness of the lower flange part 242*b* is preferably formed to be greater than the diameter of the wire. Therefore, when the end portion (Lb) of the wire drawn while being supported by the support stepped part 248 is reinserted into the fastening groove part 244 through the via slot 242*f*, the wire can keep the state in which the wire is supported and bent on the inner surface of the via slot 242*f*. In other words, the bent portion (Lc) of the wire passes between the second coupling hole 245*b* and the via slot 242*f*, which are spaced at a minimum distance therebetween, and is simultaneously supported on the inner surfaces of the support stepped part 248 and the via slot 242*f*.

Therefore, since the bending angle between the inner surfaces facing the bent portion (Lc) of the wire is formed to be minimized, the wire (L) can be firmly fastened, and the release of the wire (L) can be prevented even if the device is manipulated repeatedly. Additionally, since the wire (L) is firmly fastened just by a simple method of adjusting the interval between fastened portions of the wire (L) or of forming a stepped portion, the present invention can remarkably improve productivity since the reel part 240 is designed and manufactured simply.

Furthermore, the via slot 242*f* and the second coupling hole 245*b* are preferably divided by the partition wall 245*d* having one or more edge parts 245*e* at the outer ends thereof.

In detail, the wire (L) is fastened to surround the outer end of the partition wall 245*d* which vertically divides the second coupling hole 245*b* and the via slot 242*f* while passing through the first coupling hole 245*a*, the second coupling hole 245*b*, and the via slot 242*f* In this instance, the partition wall 245*d* has at least one edge part 245*e* formed on the outer surface thereof so that a bent portion (Lc) of the wire surrounding the partition wall 245*d* is supported by the edge part 245*e* and is sharply bent. Accordingly, when the wire (L) surrounding the outer end of the partition wall (245D) is used for a long time after being fastened, the present invention can fasten the wire more firmly since preventing loosening in the opposite direction In the drawing, it is illustrated that a cross-sectional shape of the partition wall 245*d* corresponds to a triangular shape since the edge part 245*e* is formed as a single piece on the outer surface side, but there may be two edge parts 245*e* which are formed to correspond to a rectangular shape, and such a variation is within the scope of the present invention.

Figure 8:
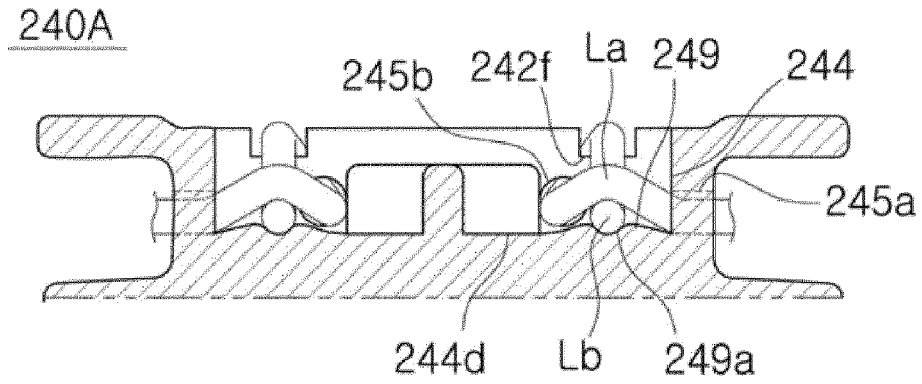
FIG. 8 is a sectional view illustrating a modification of the reel part applied to the wire winding adjusting device according to an embodiment of the present invention.

FIG. 8 is a cross-sectional view of a modification of a reel part applied to a wire winding adjusting device according to an embodiment of the present invention. The modification is the same as the above embodiment in the basic configuration except for a protrusion 249, so, a detailed description of the same configuration will be omitted. FIG. 8 is a sectional view illustrating a state in which the lower surface of the reel part 240 is arranged upwards. In the following description, it would be understood that portions which are expressed as "downwards" or "lower side" are illustrated "upwards" or "upper side" in the drawings.

As illustrated in FIG. 8, a protrusion part 249 in which the end portion (Lb) of the wire is aligned and supported is formed on the bottom surface 244*d* of the fastening groove part 244 to be stepped.

In detail, the protrusion part 249 is a stepped jaw protruding from the bottom surface 244*d* of the fastening groove part 244 corresponding in the vertical direction of the via slot 242*f*, so that the bottom surface 244*d* of the fastening groove part 244 and the protruding outer surface of the protrusion part 249 are formed to be stepped to a predetermined protrusion height. In this instance, the protrusion height of the protrusion part 249 is set to be a point between ends of the bottom surface 244*d* of the fastening groove part 244 and the bottom surface 244*d* of the via slot 242*f*. Therefore, the bottom surface 244*d* of the fastening groove part 244, the protrusion part 249, and the via slot 242*f* can be formed to be stepped in multiple stages. In addition, a seating groove 249*a* on which the end portion (Lb) of the wire is seated is formed at the center of the protrusion part 249.

Accordingly, the end portion (Lb) of the wire reinserted into the fastening groove part 244 through the via slot 242*f* is formed to be stepped at the same time as the bottom surface 244*d* of the fastening groove part 244 and the via slot 242*f*. Therefore, power that the portion (La) of the wire presses the end portion (Lb) of the wire increases more, and the state in which the end portion (Lb) of the wire is bent by the portion (La) of the wire can be maintained firmly.

Moreover, the fastening position is fixed while the end portion (Lb) of the wire is seated on the seating groove 249*a*, and the contact area where the end portion (Lb) of the wire and the portion (La) of the wire press each other can be increased relatively. Accordingly, the present invention can remarkably enhance assembly stability by fastening the wire more firmly since an area where the end portion (Lb) of the wire causes a friction not only with the portion (La) of the wire but also with the seating groove 249*a*. Furthermore, since both sides of the seating groove 249*a* are stepped when the seating groove 249*a* is recessed, the position that the end portion (Lb) of the wire is inserted is aligned automatically. So, the wire (L) can be more easily fastened to the reel part 240A.

The wire winding adjusting device 200 according to the present invention can entirely utilize also the central portion of the reel part 240 as a fastening space for fastening the wire (L), differently from the conventional arts in which both ends of the wire (L) are fastened in a rotationally symmetrical form in the narrow space of the outer circumference since the central portion is penetrated. Additionally, the coupling holes 245*a* and 245*b* and the via slots 242*f* are formed to be bilaterally symmetrical so that the fastening direction of the wire (L) is constant, thereby facilitating attachment and fastening work.

In this instance, since the via slot 242*f* is formed in the lower flange part 242*b* corresponding to the end portion of the opening of the fastening groove part 244, a pressing step capable of firmly pressing the end portion (Lb) of the wire is formed to the maximum at the portion (La) of the wire even if the thickness of the winding body part 241 is not increased. Accordingly, the reel part 240 can be manufactured to have the minimum thickness, and a product to which the reel part 240 is applied can be made compact. Moreover, the portion (La) of the wire passing through the first coupling hole 245*a* and the second coupling hole 245*b* is supported and bent on one side of the support stepped part 248 continuously extending and protruding to the inner circumferential surface 245*c* of the second coupling hole 245*b* so as to fix the bent state. Accordingly, the fastened state of the wire (L) can be firmly maintained even during repetitive manipulation of the product.

Second Embodiment

Hereinafter, preferred embodiments of the present invention will be described in detail with reference to the accompanying drawings. Additionally, the embodiments which will be described hereinafter do not unfairly limit the contents of the present invention described in claims, and the entire configuration described in the present embodiments is not necessary to be essential as a solution of the present invention. It will be appreciated that descriptions of matters obvious to those skilled in the art may be omitted and the description of such omitted components (methods) and functions will be fully referred within the scope of the present invention without departing from the spirit and scope of the present invention.

Figure 9:
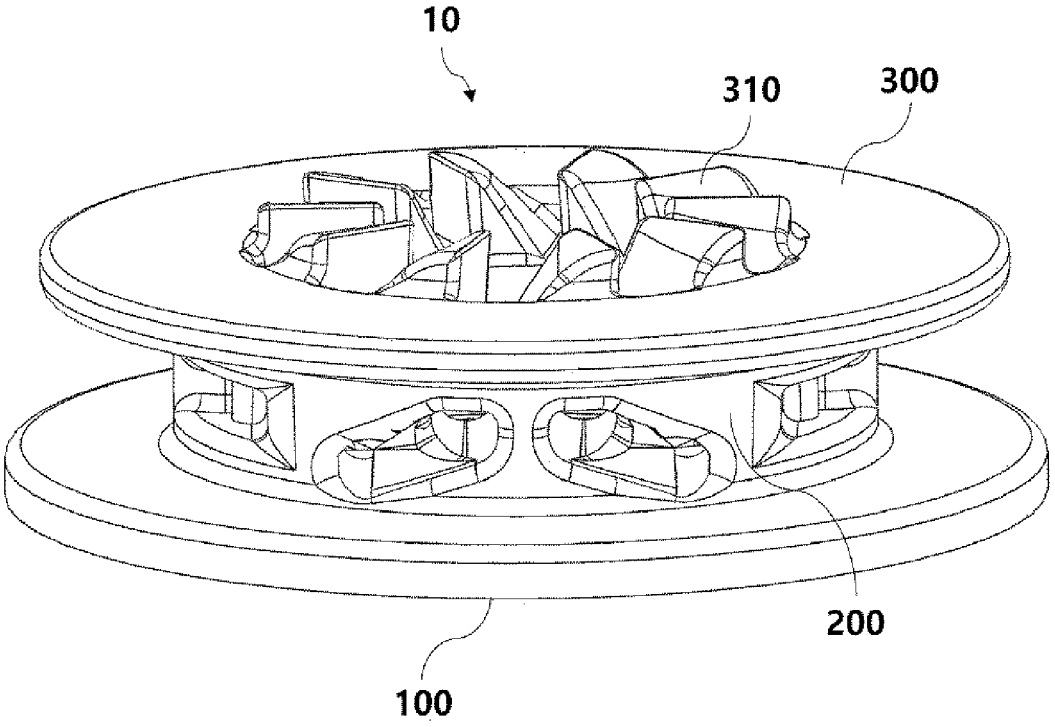
FIG. 9 is a view illustrating a gear part according to an embodiment of the present invention.

As shown in FIG. 9, the wire reel 10 according to an embodiment of the present invention is one of components of the shoe tightening device described in the conventional arts, and is a device for winding a wire by rotation. With respect to the shoe tightening device, you can refer to the conventional arts within the scope of the present invention without departing from the spirit and scope of the present invention. As shown in FIG. 9, the wire reel 10 includes a wire fastening part 100, a wire winding part 200, and a gear part 300. The wire fastening part 100, the wire winding part 200, and the gear part 300 are described separately for convenience of description, but may be formed integrally.

Figure 10:
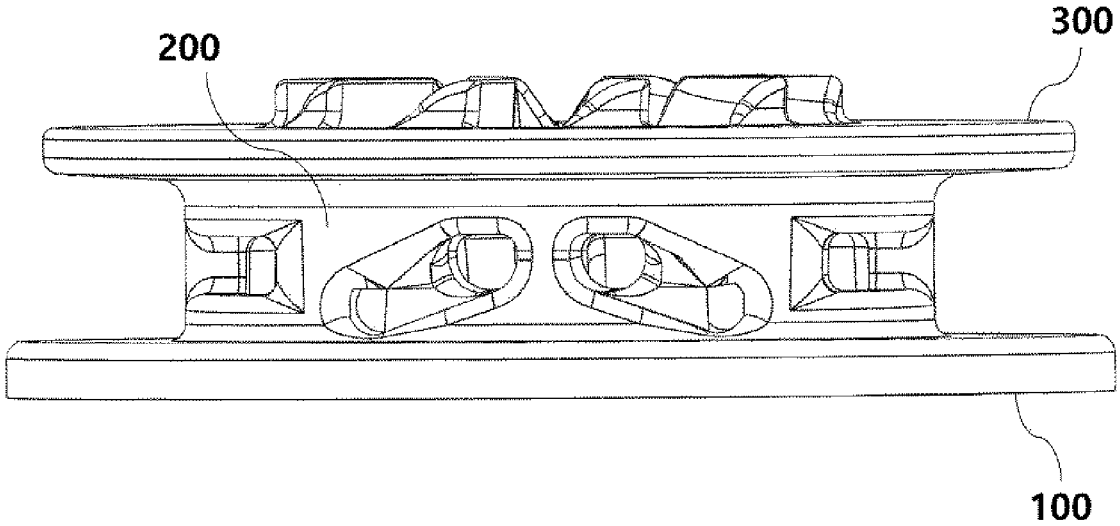
FIG. 10 is a view illustrating a wire winding part according to an embodiment of the present invention.

The gear part 300 is formed on the first side (or upper side with reference to FIGS. 9 and 10). The gear part 300 includes a gear 310 protruding outwards. The gear 310 is gear-engaged with the external component to interlock with each other so that the wire reel 10 is rotated.

Figure 11:
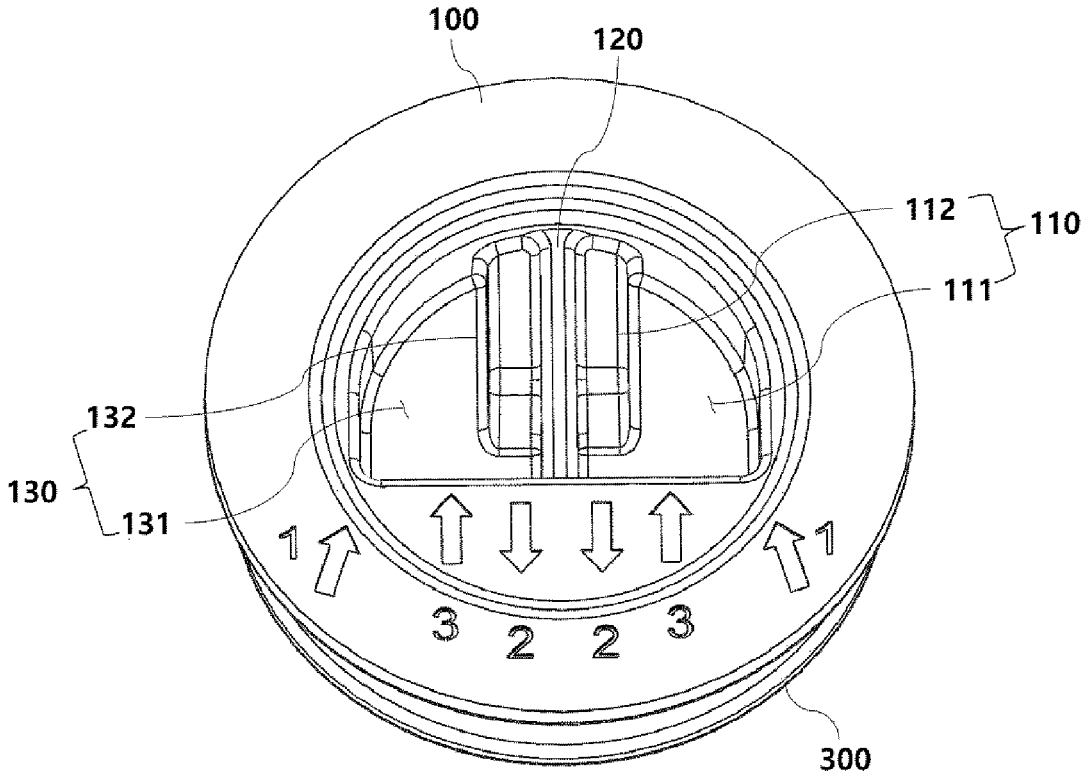
FIGS. 11 and 12 are views illustrating a wire fastening part according to an embodiment of the present invention.

The wire fastening part 100 is formed on a second side (or a lower side with reference to FIGS. 9 and 10). The wire fastening part 100 includes a first wire fastening part 110, a central partition wall 120, and a second wire fastening part 130, as shown in FIGS. 11 to 15. The first wire fastening part 110 and the second wire fastening part 130 are separated from each other by the central partition wall 120. Referring to FIG. 11, the first wire fastening part 110 is formed on the right side and the second wire fastening part 130 is formed on the left side. The first wire fastening part 110 fixes and couples one end portion of the wire, and the second wire fastening part 130 fixes and couples the other end portion of the wire. The first wire fastening part 110 and the second wire fastening part 130 are made in the same shape structure. Therefore, hereinafter, only the first wire fastening portion 110 will be described, and the second wire fastening portion 130 will be referred to as the description of the first wire fastening portion 110.

The first wire fastening part 110 includes a first wire fastening groove 111 and a first inclined wall 112. The first wire fastening groove 111 is formed as a groove to be formed from the body 100 as shown in FIG. 11. The first wire fastening groove 111 is fixed and fastened while the wire 11 passes in the first, second, and third directions. Here, the first direction is a direction in which the wire 11 is inserted into the body from the outside through the first wire through-hole 211, and the second direction is a direction in which the wire 11 inserted into the body is drawn out from the inside of the body, and the third direction is the same direction as the first direction.

Figure 12:
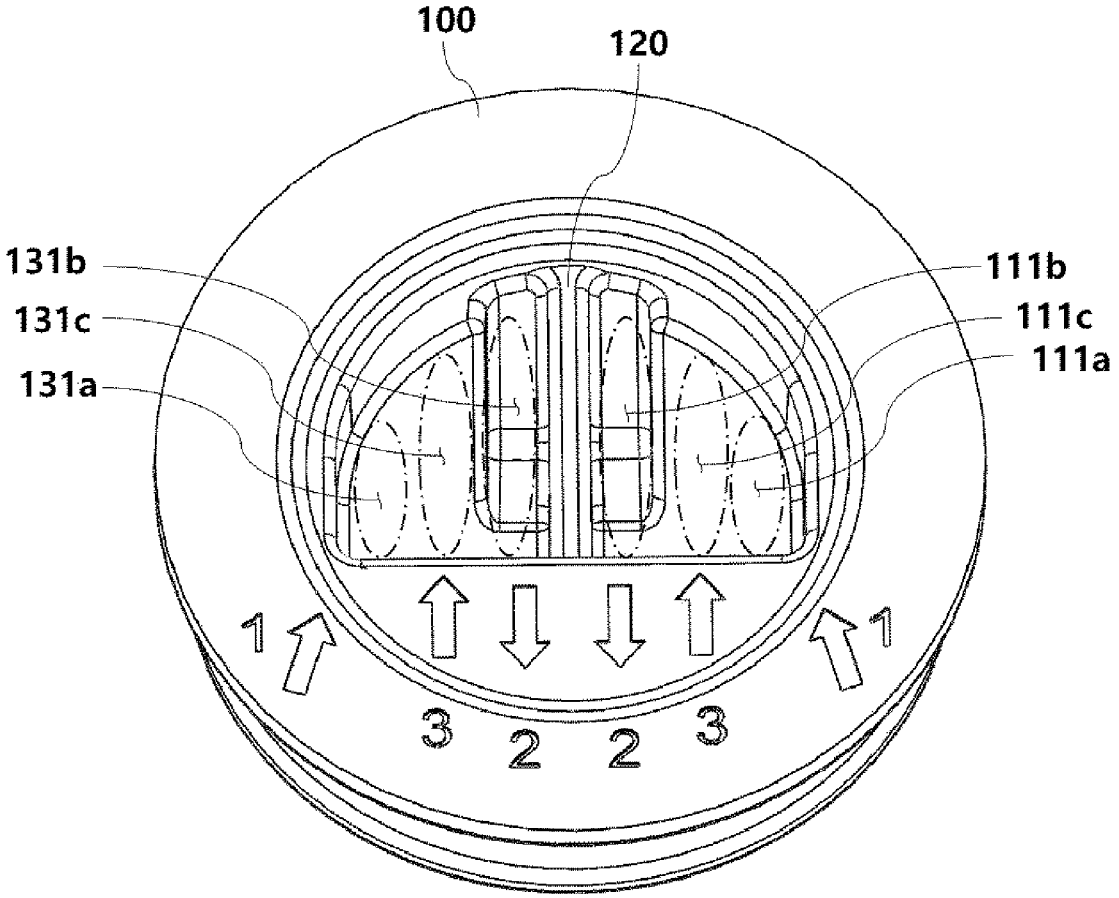
Figure 13:
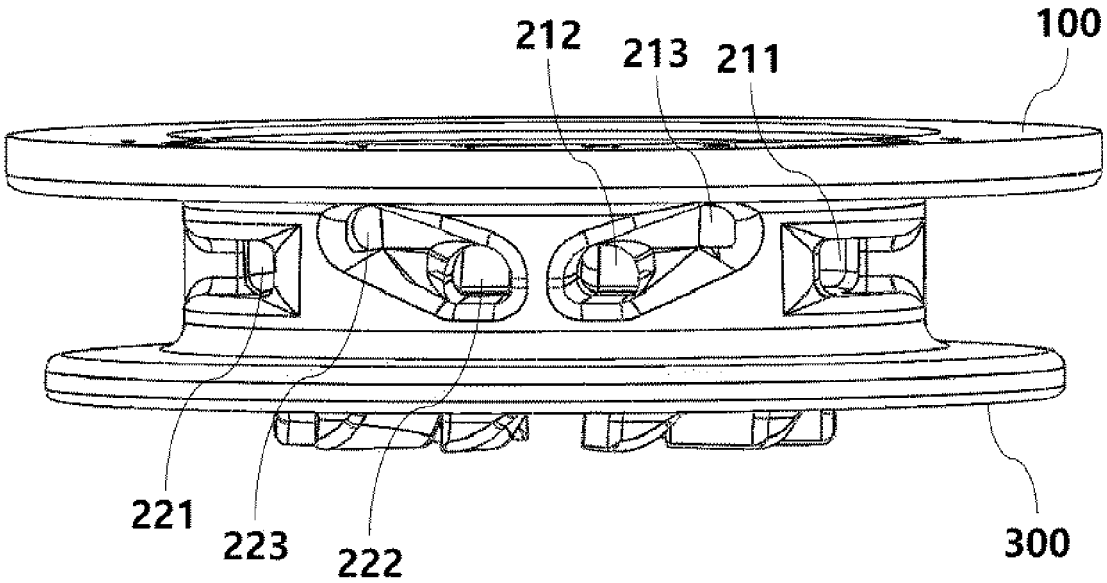
FIGS. 13 and 14 are views illustrating first, second, and third wire through holes according to an embodiment of the present invention.
Figure 14:
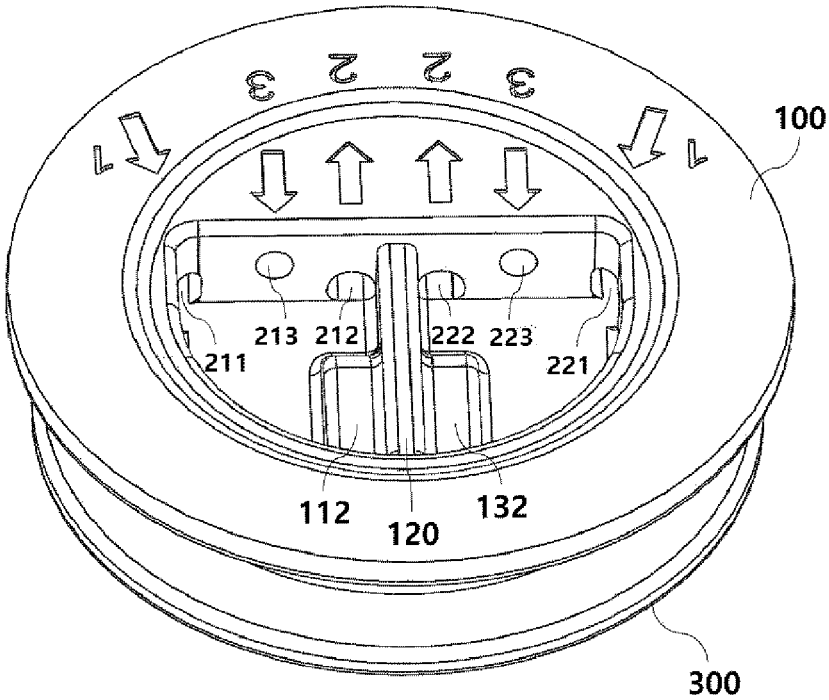

As illustrated in FIG. 12, first, second, and third direction fastening areas 111*a*, 111*b*, and 111*c* are formed in an area of the first wire fastening groove 111 virtually. The first direction fastening area 111*a* is an area through which is spaced uttermost from the central partition wall 120. The second direction fastening area 111*b* is an area that the wire passing the first direction fastening area 111*a* passes to get out a second wire through-hole 212 illustrated in FIG. 13 from the inside of the body to the outside, namely, in the second direction. The second direction fastening area 111*b* is the nearest area to the central partition wall 120. The third direction fastening area 111*c* is an area that the wire is inserted through a third wire through-hole 213 illustrated in FIG. 13 from the outside of the body to the inside, namely, in the third direction. The third direction fastening area 111*c* is a space between the first direction fastening area 111*a* and the second direction fastening area 111*b*. The third direction fastening area 111*c* is an area in which one end portion of the wire is fixed and fastened.

Figure 15:
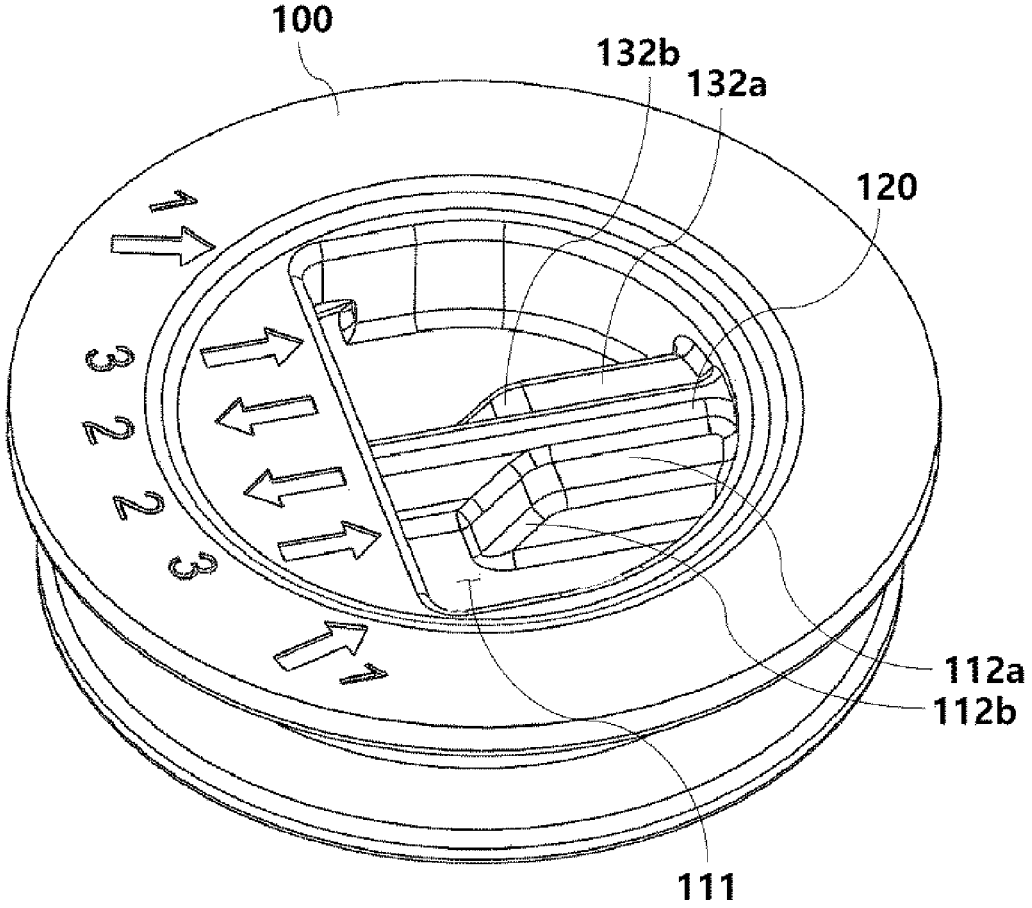
FIG. 15 is a view illustrating horizontal portions and inclined part of the first and second gradient part according to an embodiment of the present invention.

As illustrated in FIG. 15, the first inclined wall 112 guides the wire 11 entering the second direction fastening area 111*b* to enter the second wire through hole 212, and prevents interference when the end portion of the wire is fastened. The interference prevention will be described later with reference to FIG. 21. The first inclined wall 112 includes a horizontal part 112*a* and an inclined part 112*b*.

The horizontal part 112*a* extends along the longitudinal direction of the central partition wall 120 while being in contact with the central partition wall 120, and is formed relatively lower than the central partition wall 120. Since the horizontal part 112*a* is formed to be lower than the central partition wall 120, the wire 11 can be guided. The horizontal part 112*a* may be formed on a level with the central partition wall 120, but in such a case, the wire 11 is not guided well. Additionally, preferably, the horizontal part 112*a* is longer than the inclined part 112*b*.

The inclined part 112*b* extends from the horizontal part 112*a* along the longitudinal direction of the central partition wall 120 while being in contact with the central partition wall 120, and is preferably shorter than the horizontal part 112*a*. The inclined part 112*b* is inclined and extended along the longitudinal direction of the central partition wall 120 and the inclination of the inclined part 112*b* ends before the second wire through-hole 212, so that the entire length of the first inclined wall 112 is shorter than the central partition wall 120. Preferably, the length of the horizontal portion 112*a* is more than 50% of the total length of the first inclined wall 112, so that the end portion of the wire can be prevented from interfering with the wire seated in the third direction fastening area when being fastened and fixed in the third direction fastening area 111*c* (see FIG. 21). Preferably, the horizontal part 112*a* and the inclined part 112*b* are separately described for convenience of explanation, but preferably, are formed integrally. The inclined part 112*b* is formed to be gradually inclined toward the second wire through-hole 212 from the point connected to the horizontal part 112*a*.

The second wire fastening part 130 is formed to correspond to the opposite side of the first wire fastening part 110, and a detailed description of the second wire fastening part 130 is substituted for the description of the first wire fastening part 110.

The central partition wall 120 forms a wall to bisect wire fastening groove 111 and 131 which are in an approximately semicircular shape in a cross section.

The wire winding part 200 is formed so that the wire can be wound in a space between the wire fastening part 100 and the gear part 300. A diameter of the gear part 300 is smaller than that of the wire fastening part 100, and a diameter of the wire winding part 200 is smaller than that of the gear part 300 so that the wire can be wound along the circumferential surface. The wire winding part 200 has a first wire through-hole 211, through which the wire is first inserted in the first direction, and which is formed through the circumferential surface of the wire winding part 200. In addition, the second wire through-hole 212 through which the wire is inserted in the second direction is formed to be spaced apart from the first wire through-hole 211 at a predetermined distance, and is formed through the circumferential surface of the wire winding unit 200. The third wire through-hole 213 through which the wire is inserted in the third direction is formed at a predetermined distance between the first wire through-hole 211 and the second wire through-hole 212, and is formed through the circumferential surface. The first, second, and third wire through-holes 221, 222, and 223 are formed to correspond to the first, second, and third wire through-holes 211, 212, and 213 by means of a reference line. The first, second, and third wire through-holes 221, 222, and 223 allow the wire to be inserted in the first, second, and third directions as described above.

Hereinafter, a method of fastening and fixing a wire to the first and second wire fastening grooves 111 and 131 will now be described. Similarly, that the wire is fastened and fixed to the second wire fastening groove 131 is substituted for the description of fastening method of the first wire fastening groove 111.

Figure 16:
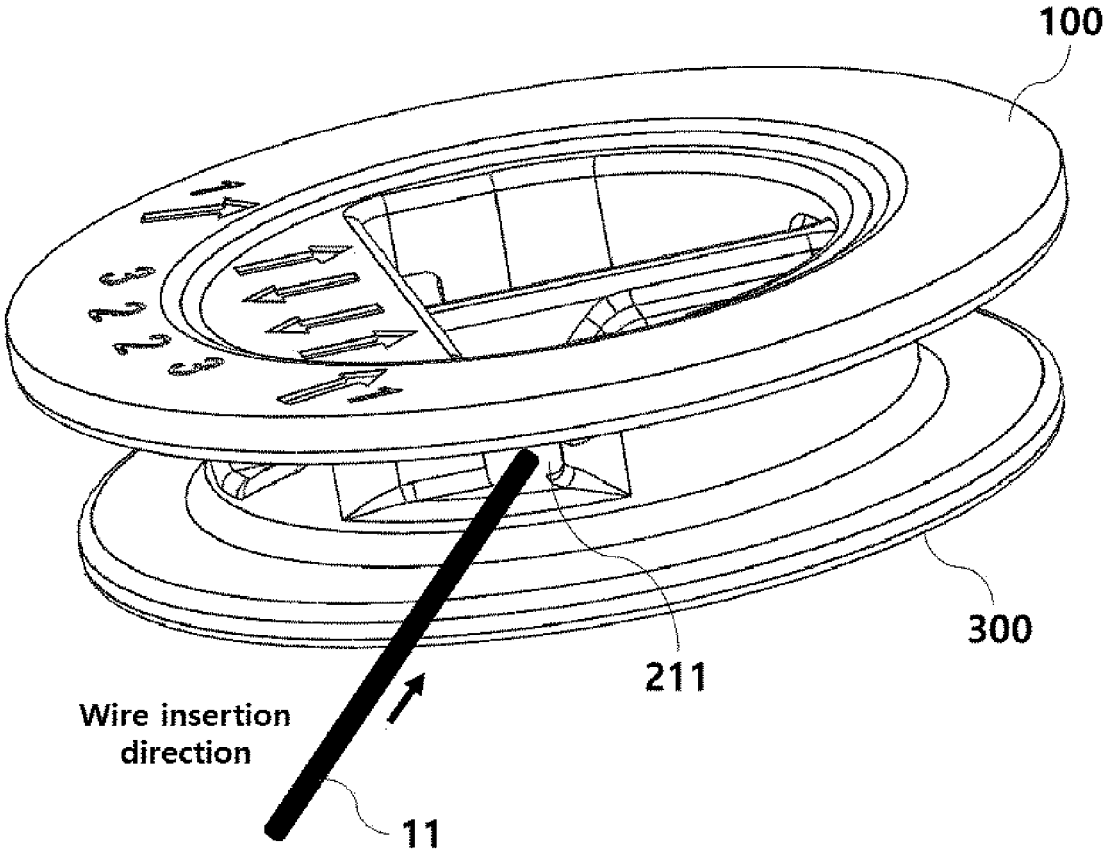
FIGS. 16 to 24 are views illustrating a wire insertion method according to an embodiment of the present invention in consecutive order.
Figure 17:
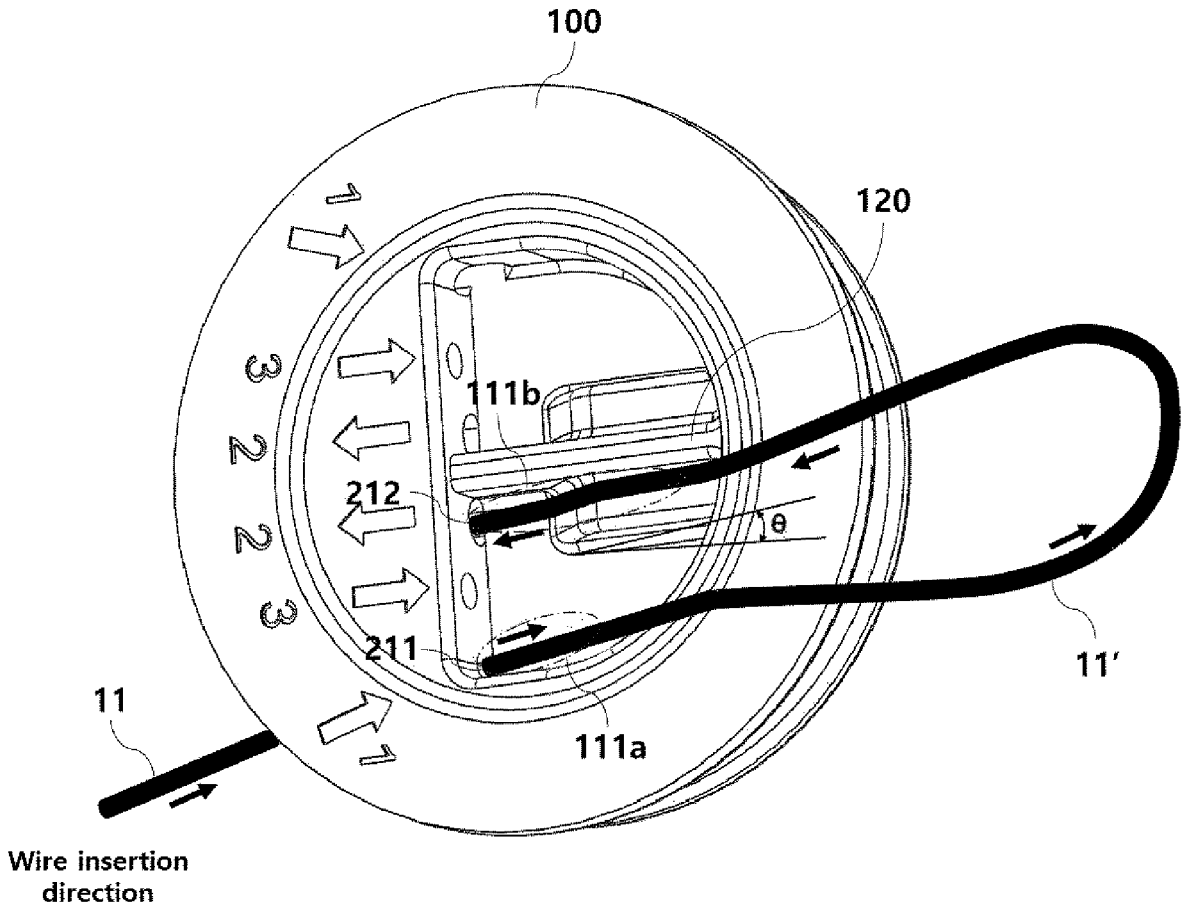

As illustrated in FIG. 16, the wire 11 is inserted in the first direction from the outside of the body 100 through the first wire through-hole 211. As illustrated in FIG. 17, the wire 11 inserted in the first direction passes through the first direction fastening area 111*a*, enters the second direction fastening area 111*b*, and exits from the inside of the body 100 through the second wire through-hole 212, that is, in the second direction. In this instance, as illustrated in FIG. 17, a wire 11' is lifted at a predetermined angle by the first inclined wall 122.

Figure 18:
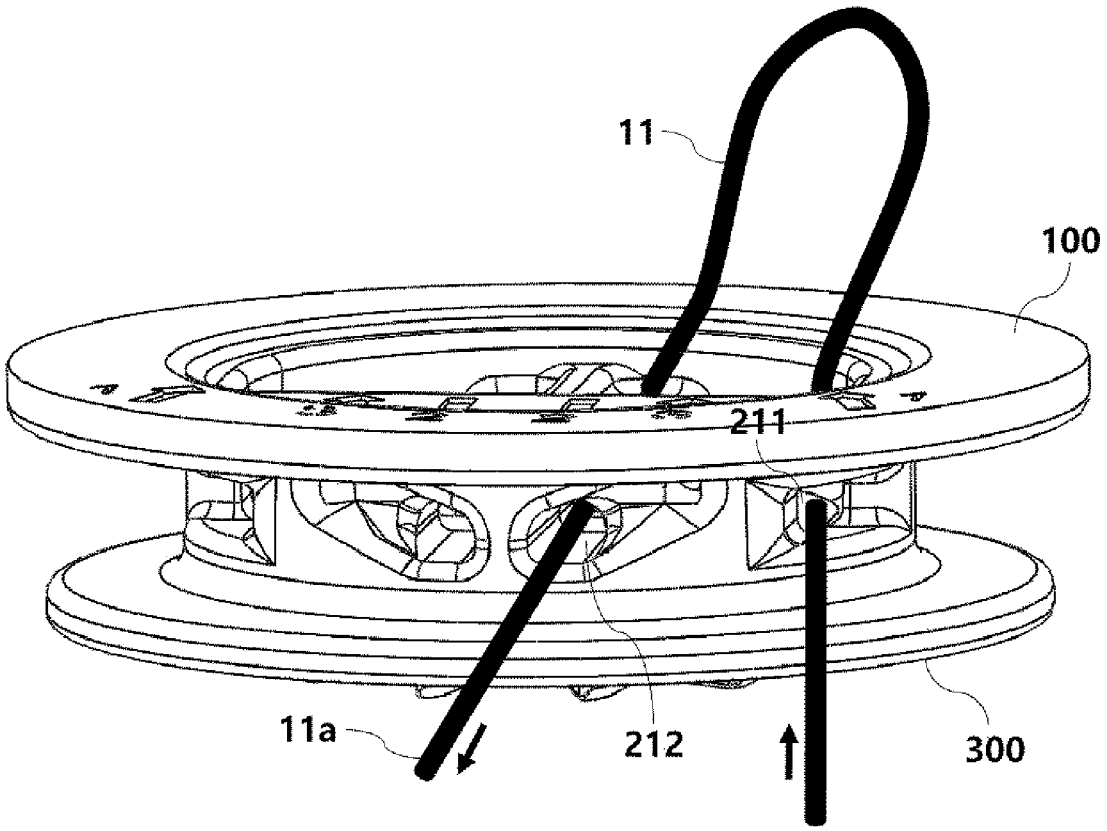
Figure 19:
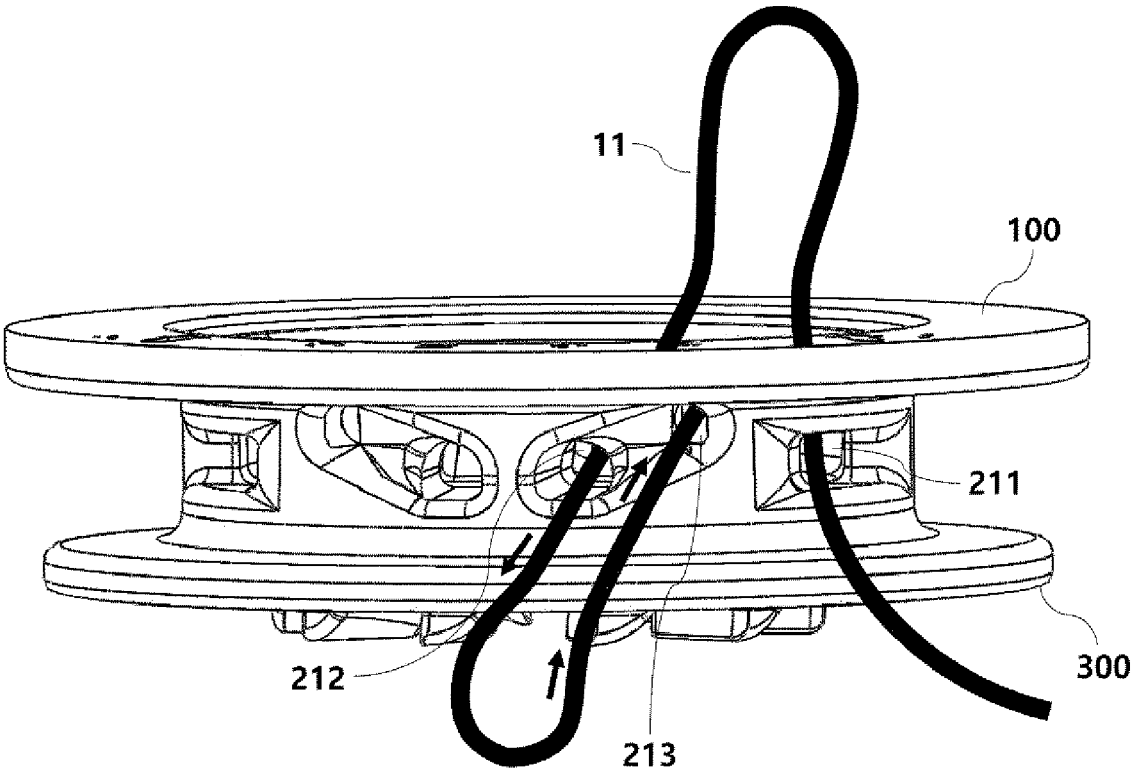
Figure 20:
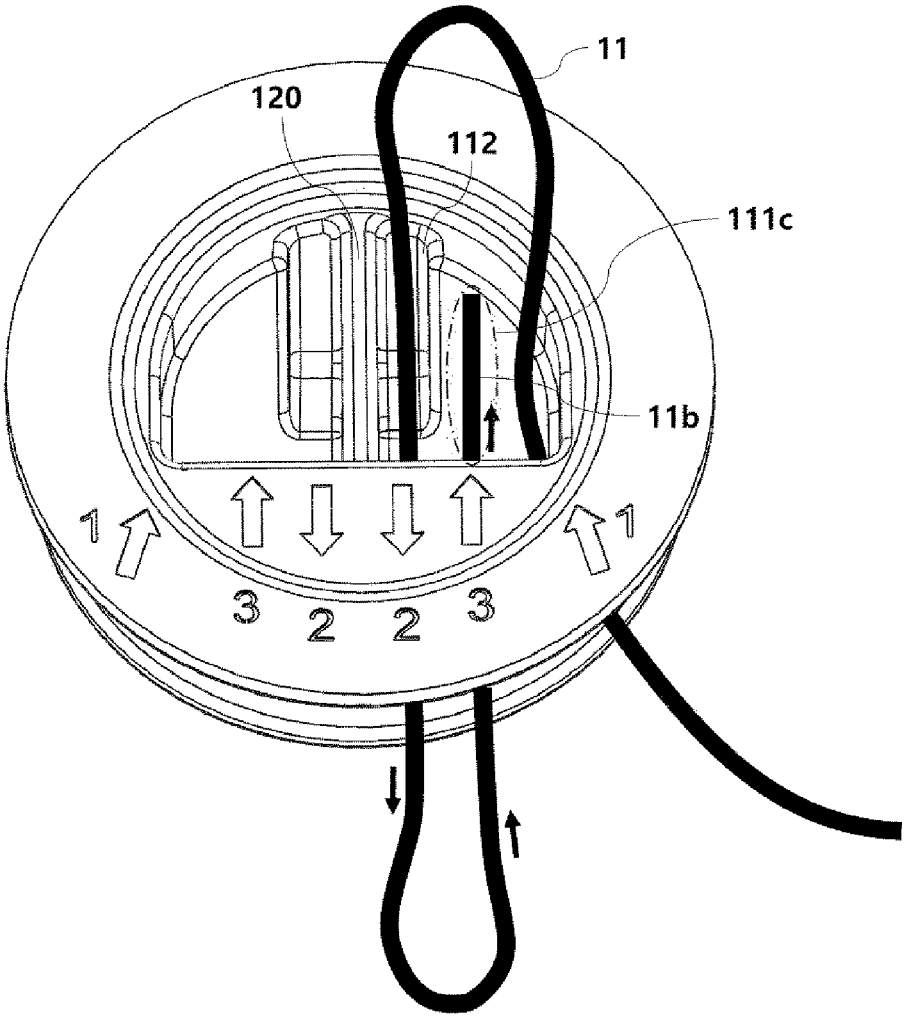

As illustrated in FIG. 18, the wire 11*a* discharged out of the body 100 through the second wire through hole 212 in the second direction is inserted into the inside of the body 100 from the outside of the body 100 through the third wire through hole 213, namely, in the third direction, as illustrated in FIG. 19. The end of the wire 11*b* reinserted through the third wire through-hole 213 in the third direction is seated on the third direction fastening area 111*c*.

Figure 21:
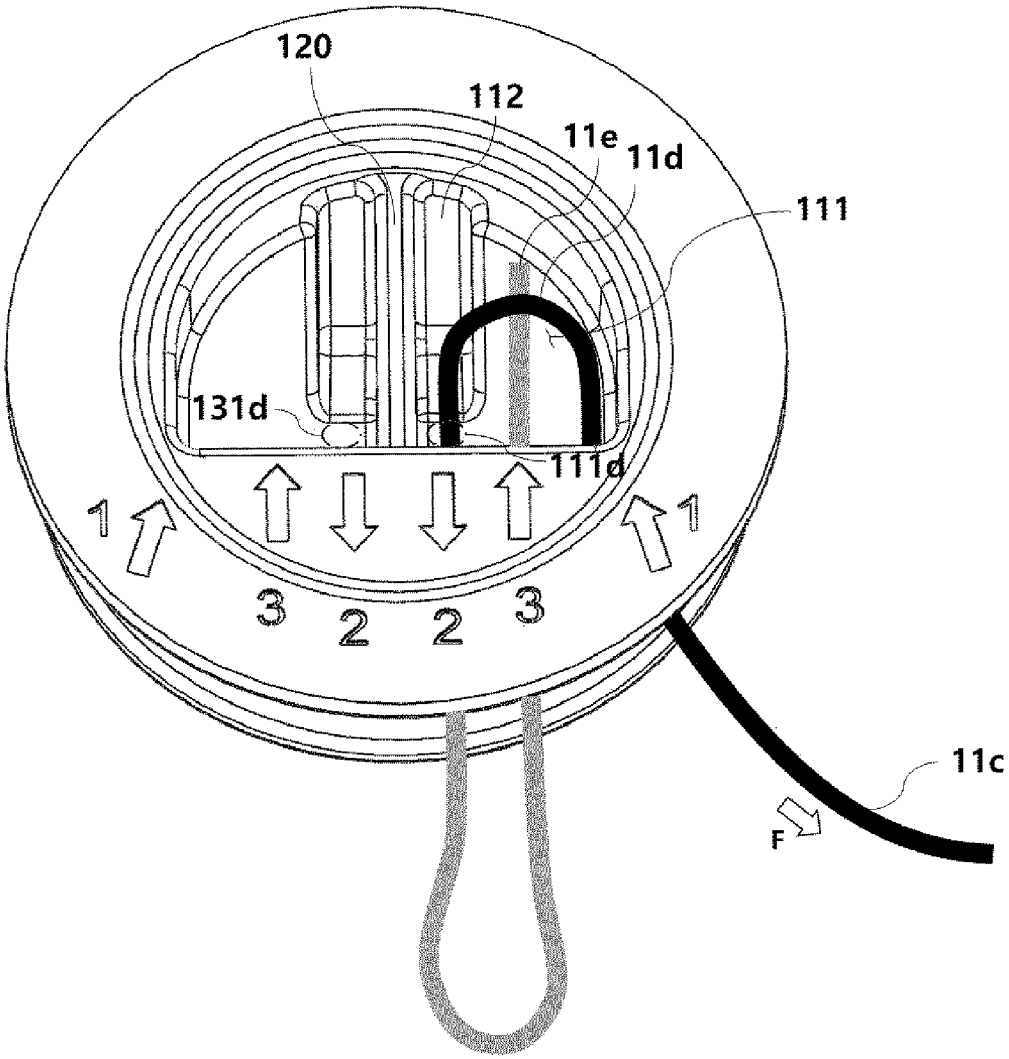

As illustrated in FIG. 21, when the wire 11*c* is pulled by external force (F), the length of the wire 11*d* is gradually reduced. In this instance, the wire 11*d* is supported and the wire 11*c* is pulled in a longitudinal wire support space 111*d* between the inclined part 112*b* and the second wire through-hole 212. Here, assuming that the inclined portion 112*b* of the first inclined wall 112 gets longer than the first inclined wall 112, that is, if the horizontal portion 112*a* is shorter than that illustrated in FIG. 21, an angle of the wire 11*d* (illustrated in FIG. 17) is small, namely, the wire lies relatively more horizontally, and if the angle of the wire 11*d* is small, the wire 11*d* is reduced since the wire 11*c* is pulled, and the probability of interfering the wire 11*e* is increased. Therefore, it is preferable that the horizontal part 112*a* be longer than the inclined part 112*b*.

Figure 22:
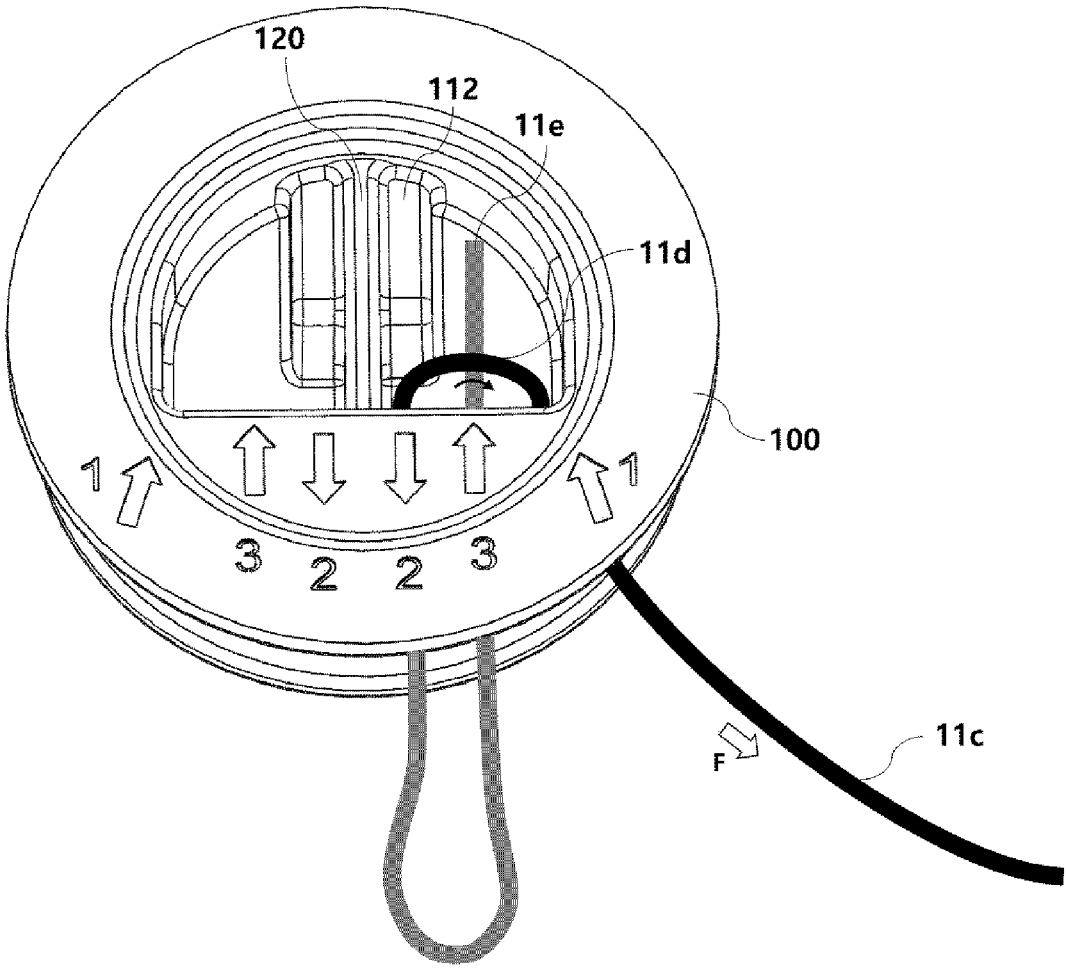
Figure 23:
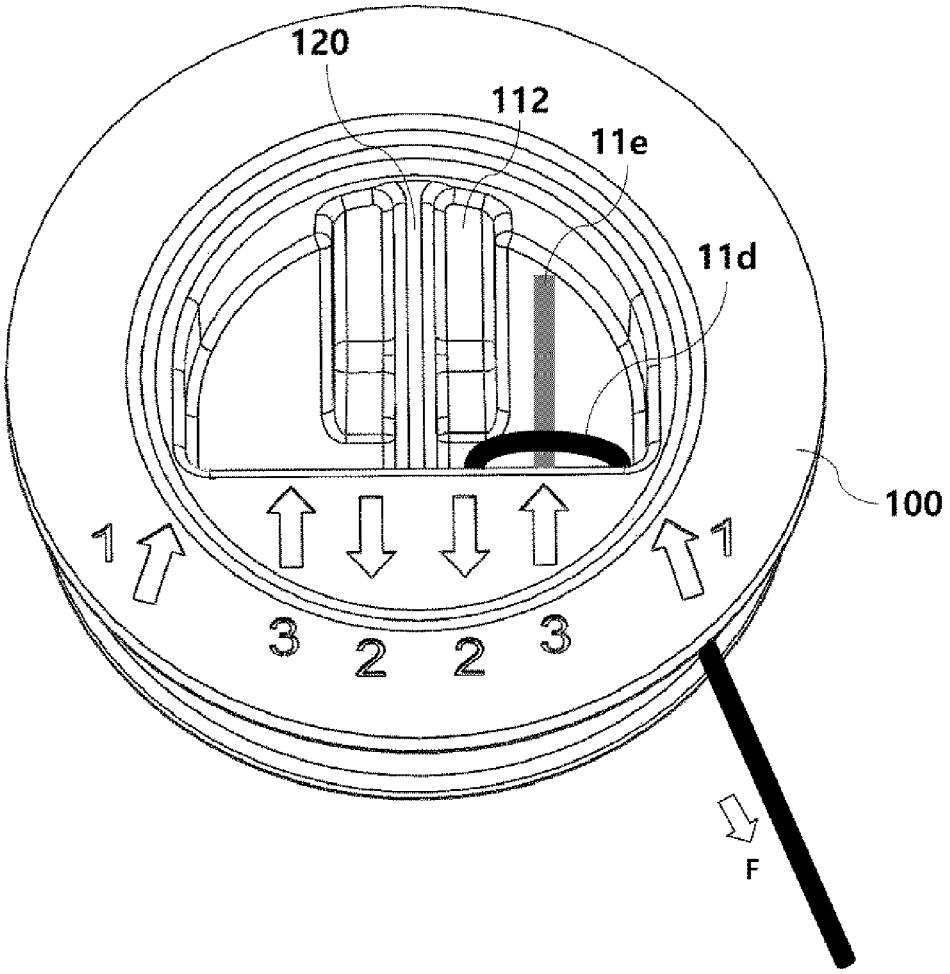
Figure 24:
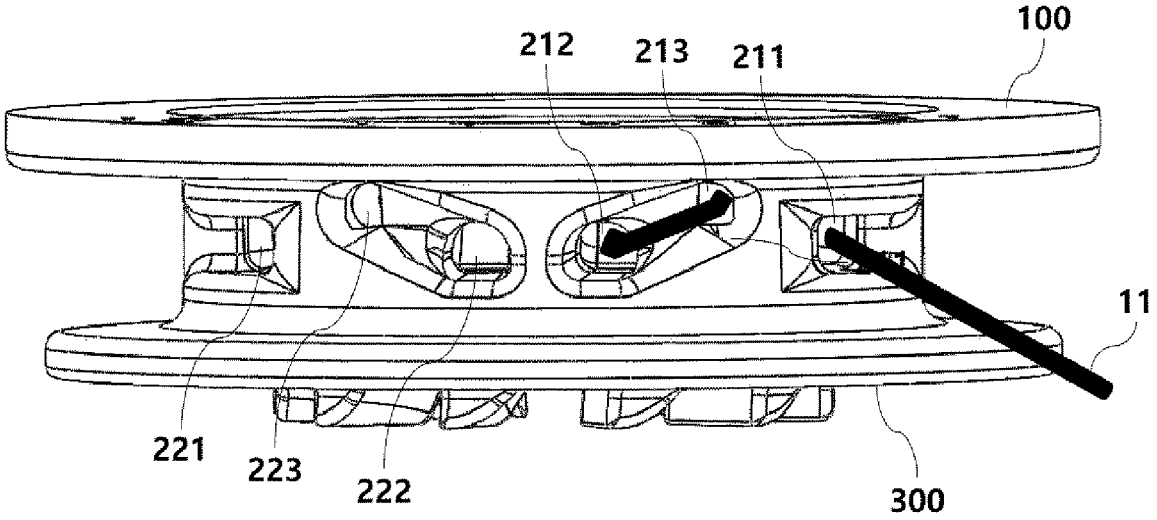

As illustrated in FIGS. 22 and 23, the wire 11*e* is pressed and fastened by the wire 11*d* in the third direction fastening area 111*c* since the wire 11*c* is pulled continuously.

Figure 25:
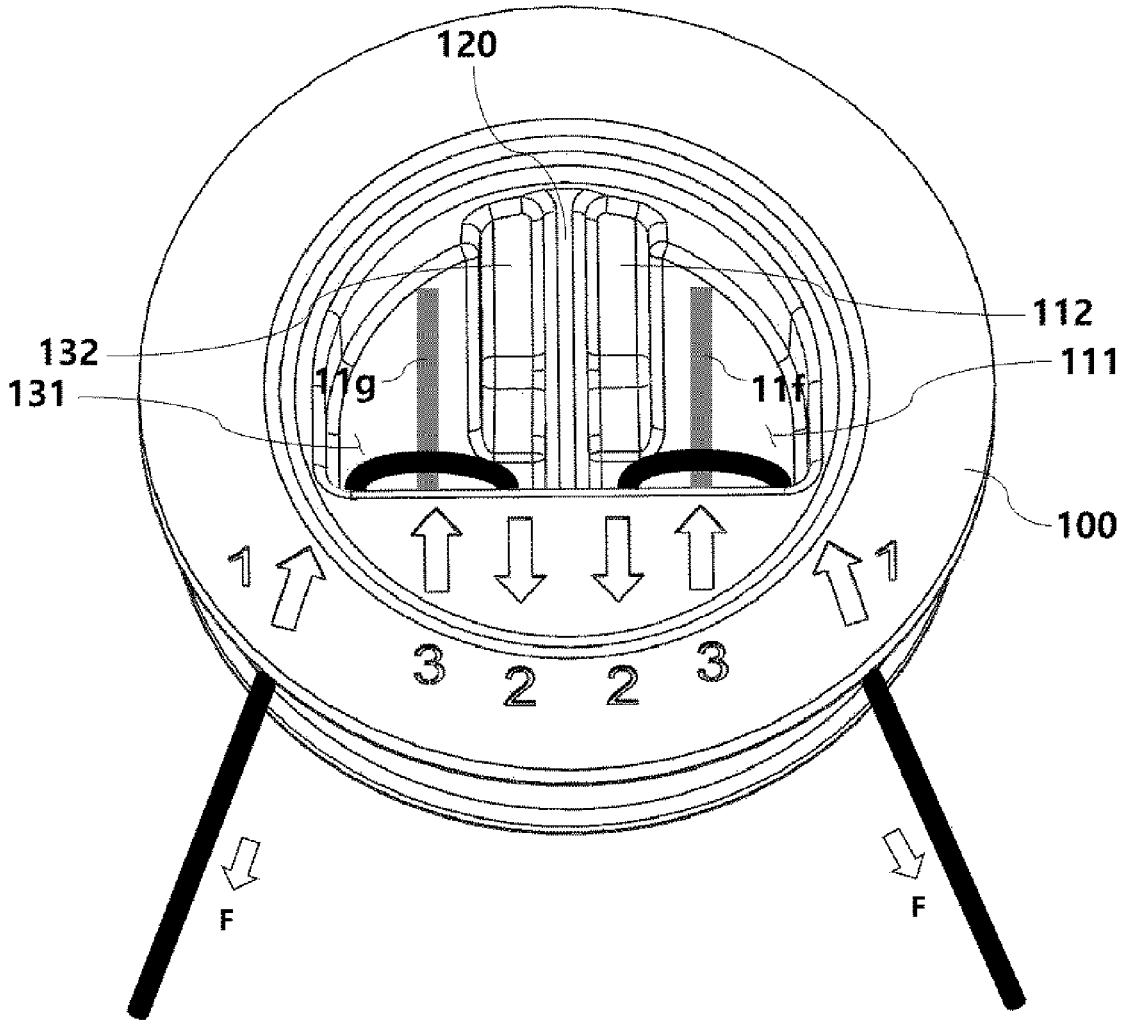
FIG. 25 is a view illustrating that one end portion and the other end portion of the wire according to an embodiment of the present invention are all fastened.

A first end portion 11*f* of the wire 11 is fastened and fixed at the first wire fastening groove 111, and a second end portion 11*g* of the wire 11 is fastened and fixed at the second wire fastening groove 131 as illustrated in FIG. 25.

Terms such as "include", "form" or "have" as described above means that a concerned element may be inherent in the concerned element unless there is any statement specifically to the contrary. In this regard, such terms should be interpreted that the elements may further include other elements instead of excluding other elements. All terms including technical or scientific terms have the same meaning as generally understood by the person having the typical knowledge in the technical field to which the present invention belongs unless otherwise defined. Terms which are generally used as terms defined in dictionary should be interpreted as being consistent with the meaning in context of the relevant technology and will not be interpreted as idealistic or excessively formal meaning.

As described above, the present invention is not limited to each of the embodiments described above, and it is possible to be modified by a person skilled in the art to which the present invention belongs, without departing from the scope of the present invention, and such a modification is within the scope of the present invention.

It will be appreciated that descriptions of matters obvious to those skilled in the art may be omitted and the description of such omitted components (methods) and functions will be fully referred within the scope of the present invention without departing from the spirit and scope of the present invention. In addition, the components of the present invention described above have been described for the convenience of explanation, and the elements not described herein can be added within the scope of the present invention without departing from the spirit and scope of the present invention.

The above-described configurations and functions of the components are separately described for convenience of explanation, and as necessary, any one configuration and function may be integrated into another component, or may be subdivided.

Although the present invention has been described with reference to one embodiment of the present invention, the present invention is not limited to this, and various modifications and applications are possible. That is, one skilled in the art will readily appreciate that many variations are possible within the scope of the present invention without departing from the scope of the present invention. In addition, it should be noted that a detailed description of a known function related to the present invention and a specific description of a combination relationship for configurations of the present invention may unnecessarily obscure the subject matter of the present invention, and the detailed description thereof is omitted.

The invention claimed is:

1. A wire winding adjusting device, which includes a reel part accommodated in a housing part and selectively engaging with a rotating means rotating around a driving protrusion disposed at the central portion so as to be rotated interlocking with the rotating means such that a wire is wound on the outer circumference thereof, wherein the reel part comprises:

a winding body part of a cylindrical shape, which has a receiving groove formed in the upper surface thereof such that an end portion of the driving protrusion is accommodated, a fastening groove part formed such that a lower surface is recessed, and a wire fastening part getting in contact with the bottom surface of the fastening groove part so that the wire is fastened and having a first coupling hole and a second coupling hole which are spaced apart from each other and through which a portion of the wire passes; and a pair of flange parts which expand and protrude outwards in the radial direction along upper and lower rims of the outer circumferential surface of the winding body part such that a wire winding groove can be formed between inner surfaces thereof facing each other, and which have via slots formed since the first coupling hole and the second coupling hole are spaced apart from each other in the circumferential direction such that an end portion of the wire inserted into the fastening groove part is pressed by a portion of the wire.

2. The wire winding adjusting device according to claim 1, wherein a support stepped part of which one surface is continuously extended to an inner circumferential surface of the second coupling hole protrudes on the fastening groove part so that the portion of the wire drawn out through the second coupling hole and reinserted through the via slot is bent and is supported to keep the bent state.

3. The wire winding adjusting device according to claim 1, wherein the via slot is formed in the lower flange part extending outwards in the radial direction from the edge of the opening of the fastening groove part, and the inner end portion of the via slot and the first coupling hole or the second coupling hole are spaced apart from each other in the vertical direction corresponding to the recessed depth of the fastening groove part.

4. The wire winding adjusting device according to claim 1, wherein the first coupling hole and the second coupling hole respectively have penetration paths intersecting each other at a predetermined angle, and wherein the via slot and the second coupling hole are divided by a partition wall having at least one edge portion at the outer end portion thereof.

5. The wire winding adjusting device according to claim 1, wherein a protrusion part having a seating groove on which the end portion of the wire is seated is formed to protrude on the bottom surface of the fastening groove part corresponding in the vertical direction of the via slot.

6. A wire reel comprising:

a wire winding part having first, second and third wire through-holes formed in a wire winding surface on which the wire is wound by rotation, so that the wire is inserted from the outside to the inside of a body;

a wire fastening part having a wire fastening groove recessed from the body so as to have a first direction fastening area where the wire is inserted through a first wire through-hole from the outside of the body to the inside, a second direction fastening area where the wire is inserted through a second wire through-hole from the inside of the body to the outside in the opposite direction to a first direction, and a third direction fastening area where the wire is inserted through a third wire through-hole from the outside of the body to the inside in the same direction as the first direction, so that the wire is fixed and fastened at the wire fastening groove; and a gear part having a gear which protrudes outwards from the body so that the body is rotated by engagement of the gear.

7. The wire reel according to claim 6, wherein the wire fastening groove is formed to be a horizontal groove to prevent interference caused by movement of the wire passing the first to third direction fastening areas.

8. The wire reel according to claim 7, wherein the wire fastening part comprises:

a first wire fastening part for fixing and fastening one side of the wire;

a second wire fastening part for fixing and fastening the other side of the wire; and a central partition wall formed from one side to the other side of the wire fastening groove to partition the first and second wire fastening parts.

9. The wire reel according to claim 8, wherein the first wire fastening part comprises a first wire fastening groove which is formed at one side area from the central partition wall by being cut from the body and has the first to third direction fastening areas, and a first inclined wall which gets in close contact with the central partition wall and allow the wire to enter at a predetermined angle when the wire is inserted in the second direction fastening area, and wherein the second wire fastening part comprises a second wire fastening groove which is formed at the other side area from the central partition wall by being cut from the body and has the first to third direction fastening areas, and a second inclined wall which gets in close contact with the central partition wall and allow the wire to enter at a predetermined angle when the wire is inserted in the second direction fastening area.

10. The wire reel according to claim 9, wherein the first and second inclined walls are in close contact with the central partition wall, and are shorter than the central partition wall to have a predetermined length so that the wire can be inserted through the second wire through-hole when entering the second direction fastening area.

11. The wire reel according to claim 10, wherein the first and second inclined walls are inclined in such a way that the height is reduced gradually in the inserted direction when the wire is inserted in the second direction.

12. The wire reel according to claim 11, wherein the first and second inclined walls are relatively lower than the central partition wall and are inclined in such a way that the height is reduced gradually in the inserted direction so that the wire is guided to be inserted in the direction of the second wire through-hole.

13. The wire reel according to claim 12, wherein each of the first and second inclined walls comprises:

a horizontal part which gets in close contact with the central partition wall and horizontally extends to be relatively low; and an inclined part which gets in close contact with the central partition wall, extends from the horizontal part, and is inclined in such a way that the entire length is shorter than the central partition wall so as to have a predetermined length.

14. The wire reel according to claim 13, wherein the inclined part is shorter than the horizontal part so that the wire seated in the third direction fastening area is fixed and fastened without any interference since the wire inserted in the first direction is pulled in the opposite direction to the insertion direction.

15. A wire reel comprising:

a first direction fastening area through which a wire inserted through a first wire through-hole passes from the outside of the body to the inside in a first direction;

a second direction fastening area through which the wire is discharged out through a second wire through-hole from the inside of the body to the outside in a second direction that is the opposite direction to the first direction, the second direction fastening area allowing the wire to be inclinedly inserted before entering a second wire through-hole while maintaining a predetermined height from a wire fastening groove of a body when the wire enters the second direction; and a third direction fastening area on which the wire inserted through a third wire through-hole from the outside of the body to the inside in the same direction as the first direction is seated, wherein since the wire is inclinedly inserted before entering the second wire through-hole while maintaining a predetermined height from the wire fastening groove, the wire seated on the third direction fastening area is fixed and fastened without any interference when the wire inserted in the first direction is pulled in the opposite direction to the insertion direction.

* * * * *